US008461493B1

(12) United States Patent
Cantolino et al.

(10) Patent No.: US 8,461,493 B1
(45) Date of Patent: Jun. 11, 2013

(54) ENERGY CONSERVATION SYSTEM

(75) Inventors: Christopher Cantolino, Bradenton, FL (US); Mark Oudshoorn, Parrish, FL (US)

(73) Assignee: Christopher Cantolino, Bradenton, FL (US)

( * ) Notice: Subject to any disclaimer, the term of this patent is extended or adjusted under 35 U.S.C. 154(b) by 724 days.

(21) Appl. No.: 12/653,575

(22) Filed: Dec. 16, 2009

(51) Int. Cl.
*H05B 1/02* (2006.01)

(52) U.S. Cl.
USPC ..... 219/494; 219/448.11; 219/448.12; 219/448.14; 122/14.3; 122/14.22

(58) Field of Classification Search
USPC .. 219/494, 448.11, 448.12, 448.14; 122/14.3, 122/14.22
See application file for complete search history.

(56) References Cited

U.S. PATENT DOCUMENTS 6,795,644 B2 * 9/2004 Bradenbaugh ..... 392/463
7,380,522 B2 * 6/2008 Krell et al. ..... 122/14.2
7,380,523 B2 * 6/2008 Donnelly ..... 122/14.31

* cited by examiner

*Primary Examiner* — Toan Le
(74) *Attorney, Agent, or Firm* — Arthur W. Fisher, III

(57) ABSTRACT

An energy conservation system to selectively control the operation of the heating elements of a water heater including a water storage tank operable in an automated mode to control the temperature of water within the water storage tank comprising a flow detector such as temperature sensor to sense the inlet or outlet water temperature to detect a change in temperature measured in time and duration and a tank temperature to sense the water temperature within the storage tank and generate corresponding temperature signals and a microprocessor coupled to the flow detector and tank temperature sensor to receive the corresponding signals including means to determine when there is a demand for hot water and means to determine a pattern of hot water usage over a water usage cycle to maintain the water in the water storage tank at a minimum temperature to supply a minimum quantity of hot water and increase the temperature of the water to a maximum temperature to supply a maximum quantity of hot water corresponding to the pattern of hot water usage over the water usage cycle.

14 Claims, 28 Drawing Sheets

| | Sunday | Monday | Tuesday | Wensday | Thursday | Friday | Saturday |
|---|---|---|---|---|---|---|---|
| 00:00 - 00:05 | 0 | 0 | 0 | 0 | 0 | 0 | 0 |
| 00:05 - 00:10 | 0 | 0 | 0 | 0 | 0 | 0 | 0 |
| 00:10 - 00:15 | 0 | 0 | 0 | 0 | 0 | 0 | 0 |
| 00:15 - 00:20 | 0 | 0 | 0 | 0 | 0 | 0 | 0 |
| 00:20 - 00:25 | 0 | 0 | 0 | 0 | 0 | 0 | 0 |
| 00:25 - 00:30 | 0 | 0 | 0 | 0 | 0 | 0 | 0 |
| 00:30 - 00:35 | 0 | 0 | 5 | 0 | 0 | 0 | 0 |
| 00:35 - 00:40 | 0 | 5 | 20 | 5 | 0 | 5 | 0 |
| 00:40 - 00:45 | 0 | 20 | 45 | 20 | 5 | 20 | 0 |
| 00:45 - 00:50 | 0 | 45 | 60 | 45 | 20 | 45 | 0 |
| 00:50 - 00:55 | 0 | 60 | 70 | 60 | 45 | 60 | 0 |
| 00:55 - 01:00 | 0 | 70 | 60 | 70 | 60 | 70 | 0 |
| 01:00 - 01:05 | 0 | 60 | 45 | 60 | 70 | 60 | 0 |
| 01:05 - 01:10 | 0 | 45 | 20 | 45 | 60 | 45 | 0 |
| 01:10 - 01:15 | 0 | 20 | 5 | 20 | 45 | 20 | 0 |
| 01:15 - 01:20 | 0 | 5 | 0 | 5 | 20 | 5 | 0 |
| 01:20 - 01:25 | 0 | 0 | 0 | 0 | 5 | 0 | 0 |
| 01:25 - 01:30 | 0 | 0 | 0 | 0 | 0 | 0 | 0 |
| 01:30 - 01:35 | 0 | 0 | 0 | 0 | 0 | 0 | 0 |
| 01:35 - 01:40 | 0 | 0 | 0 | 0 | 0 | 0 | 0 |
| 01:40 - 01:45 | 0 | 0 | 0 | 0 | 0 | 0 | 0 |
| 01:45 - 01:50 | 0 | 0 | 0 | 0 | 0 | 0 | 0 |
| 01:50 - 01:55 | 0 | 0 | 0 | 0 | 0 | 0 | 0 |
| 01:55 - 02:00 | 0 | 0 | 0 | 0 | 0 | 0 | 0 |

FIG. 18

MONDAY THROUGH FRIDAY

ENERGY CONSERVATION SYSTEM

BACKGROUND OF THE INVENTION

1. Field of the Invention

An energy conservation system to selectively control the temperature of water within a water storage tank based upon predicted hot water usage derived from historical data.

2. Description of the Prior Art

The amount of energy used to heat and cool most homes in the United States typically consumes a substantial portion of an annual energy budget. Hot water heating is another significant draw on the consumption of energy. Although many water heating options are available in the United States, storage water heaters are the most commonly used as such heaters are relatively easy and inexpensive to install. Energy cost for hot water production can be reduced by insulating hot water pipes leading from a water heater tank to plumbing fixtures and appliances in the home, providing an insulating jacket around a water heater's tank, lowering the water temperature maintained in a storage hot water heater's tank, and selectively reducing the amount of hot water used in the home for laundry, baths, showers, dishwashing, and other routine tasks. However, since the steps of lowering the pre-set temperature on a water heater thermostat and providing insulation each only contributes a maximum annual energy savings of approximately 5%, other means of energy savings are still needed. Another option for heating hot water is a tankless water heater. However, such systems have several disadvantages including limited flow rates and the potential need for special wiring. Moreover, people's usage patterns or habits routinely vary.

Also, these systems achieve the best energy savings when employed in homes having floor plans purposefully locating hot water faucets and appliances using hot water in consolidated locations so as to minimize the amount of plumbing conduit required, and where high efficiency fixtures are also used. Thus, with current limitations, water heating systems are not capable of providing the widespread residential energy reduction currently desired and needed for heating hot water in residential applications in the United States. Additional options for hot water generation in residential applications include heat pumps, as well as solar, integrated, and indirect systems. Even though some of these alternative systems have a lower operating cost than water heating systems, most have a higher installation cost. Other disadvantages of such alternative systems include limited suppliers and equipment availability, the need in indirect and integrated systems for heat exchanger installation, the need in solar systems for ample non-shaded roof space or other open area that receives a calculated minimum number of hours of solar radiation each day, and the difficulty in finding experienced installers.

In contrast, the present invention modifies the operation of the water heater by providing an automated system that learns to adjust current hot water availability from established patterns of hot water use. Energy savings through use of the present invention can be approximately 20% to 50% over that provided by a conventional water heater operated by a timer allowing the present invention system to typically recoup cost and installation expense in less than one year. No other known devices used for control of water heater activity so as to maintain a readily available supply of hot water for use upon demand, function in the same manner as the present invention or provide all of its features and advantages.

SUMMARY OF THE INVENTION

The present invention relates to an energy conservation system to control the operation of a water heater operable in an automated mode to provide hot water from a water storage tank preheated to one of a plurality of temperatures or temperature ranges corresponding to a plurality to demands for different quantities of hot water. The energy conservation system derives a plurality usage demands for different quantities of hot water for a usage cycle or cycles such as a week or plurality of weeks based upon a statistical usage model of hot water demands with respect to time, duration and day and quantity.

The energy conservative system comprises a system display and control enclosure to house a control and display system in combination with a water heater including a water storage tank having an inlet pipe and an outlet pipe in fluid communication with the interior of the water storage tank, at least one heat element and a thermostat. A water temperature sensor is disposed in heat transfer relationship relative to the inlet pipe or the outlet pipe to sense the cold water temperature or hot water temperature respectively and to generate and transmit a signal corresponding to the cold water temperature or the hot water temperature to a microprocessor.

The control and display system comprises a microprocessor having logic and circuitry to control the operation of the various components of the present invention including an LED module, a power supply module, a detection module and an LCD module each coupled or interconnected to the microprocessor.

The microprocessor includes a microcontroller, a clock and a memory. The microcontroller performs the logical sequence to operate the input and output circuitry and the various devices including the LED module, the power supply module, the detection module and the LCD module.

The energy conservation system measures flow events from the water storage tank with respect to time, day and duration to derive demand for hot water and predict future usage patterns taking into account for variations in time of usage from the actual demands due to habits of the user(s) schedule.

Flow events or periods are sensed and recorded by the energy conservation system. For example, a decrease in the temperature of the inlet pipe or cold water line of a predetermined amount indicates the start of flow of hot water from the water storage tank and the increase of the temperature of the inlet pipe or cold water line indicates a cession of the flow of hot water from the water storage tank. If the elapsed period of the flow is more than a predetermined period of time, the microprocessor records a demand for a predetermined maximum quantity for hot water demand or event. When the period or duration between the as the start of another flow of hot water from the water storage tank and the cession of the flow of hot water from the water storage tank is less than a predetermined period of time, the microprocessor records a predetermined minimum quantity for hot water demand or event. Of course, changes in temperature on the outlet pipe or hot water line could also be used to sense, measure and record demands for hot water.

When there is no flow of hot water through the water storage tank the temperatures sensed at the inlet pipe and outlet pipe of the water storage tank are substantially the same or equal to each other. Flow of hot water from the water storage tank may be detected or determined by comparing the temperatures of the inlet water sensed by the inlet water sensor and the outlet water by an outlet water sensor in the microprocessor and generating a flow signal when the difference between the inlet water temperature and the outlet water temperature is a predetermined amount. When the temperature difference between the inlet water and the outlet water decreased to a predetermined amount then the flow signal ceases.

The microprocessor includes means to record incrementally when the flow of water from the water storage tank starts or commences and stops or ceases to measure or detect the demand for a first quantity of hot water for a first period of time and to measure or detect the demand for the second quantity of hot water for a second period of time.

The time at which the heating element must be energized to meet the predicted hot water demand is determined by the water energized to meet the predicted hot water demand is determined by the water heater characteristics and quantity of demand for hot water adjusted for variations of actual hot water usage.

The daily time demands for hot water are recorded for a predetermined number of weekly cycles and averaged. The average peak time for the recorded demands are set back along the curve to establish a first time period set back margin from the average peak time. A second set back margin of a fixed period of time is used to offset the heating cycle prior to the predicted demand for hot water.

The energy conservation system maintains the water storage tank at a minimum temperature. The water within the water storage tank is heated by commencing to elevate the temperature to reach a first predetermined temperature or a first predetermined range to supply a first predetermined quantity of hot water at the predetermined time of day on a given day of the week or heating the water within the water storage tank to a second predetermined temperature for a second predetermined temperature range to supply a second predetermined minimum quantity of hot water at a predetermined time of day on any given day of the week derived from the duration or period of time that a hot water demand occurs comprising a plurality of cycles such as ten (10) weeks calculated to set back for a margin for habit variations.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which:

FIG. 18 is a data table depicting recorded hot water uses by day and time.

Similar reference characters refer to similar parts throughout the several views of the drawings.

DETAILED DESCRIPTION OF THE PREFERRED EMBODIMENT

The present invention relates to an energy conservation system to control the operation of a water heater operable in an automated mode to provide hot water from a water storage tank preheated to one of a plurality of temperatures or temperature ranges corresponding to a plurality of demands for different quantities of hot water. The energy conservation system derives a plurality usage demands for different quantities of hot water during a learning period over a usage cycle or cycles such as a week or plurality of weeks based upon a statistical usage model of hot water demands or usage with respect to time and day.

The mechanical aspects of the energy conservation system are best understood with references to FIGS. 1 through 8.

The most preferred embodiment of the present invention provides an energy-saving automated system 2 used for the activation of a hot water heater that at a minimum needs a small amount of data entry by its manufacturer, seller, installer, and/or user prior to activation, whereafter it provides a semi-artificial intelligence that learns to adjust current hot water availability from previously established patterns of hot water use to provide a readily available supply of hot water, for use upon demand, with significant energy savings. The data entry could be as simple as the entry of a zip code or a global positioning satellite (GPS) designation, which would provide the present invention system with general climate and seasonal information, so that energy consumption can be significantly reduced during the entire year, and not just a portion of it. However, for even better energy savings and/or when the user has at least a minimal amount of technical aptitude, the present invention system could be configured so that the amount of data entry provided by the user is more extensive, introduced at any time, and includes but is not limited to an automatic and/or manual over-ride capability for anticipated periods of heavy hot water use, automatic or manual accommodation for daylight savings time, automatic and/or manual accommodation for seasonal temperature changes, and automatic and/or manual accommodation for the ambient temperature of its installation site, manual accommodation for anticipated holiday activity, and/or regular days off of work where it is anticipated for hot water usage patterns to be distinct. The present invention system would also comprise precautions against false activation to maximize energy saving, such as establishing a minimum period of faucet on-time before any pattern modification is made. Applications include, but are not limited to, residential use and other situations where some predictability as to the time and duration of hot water use can be established.

Figure 1:
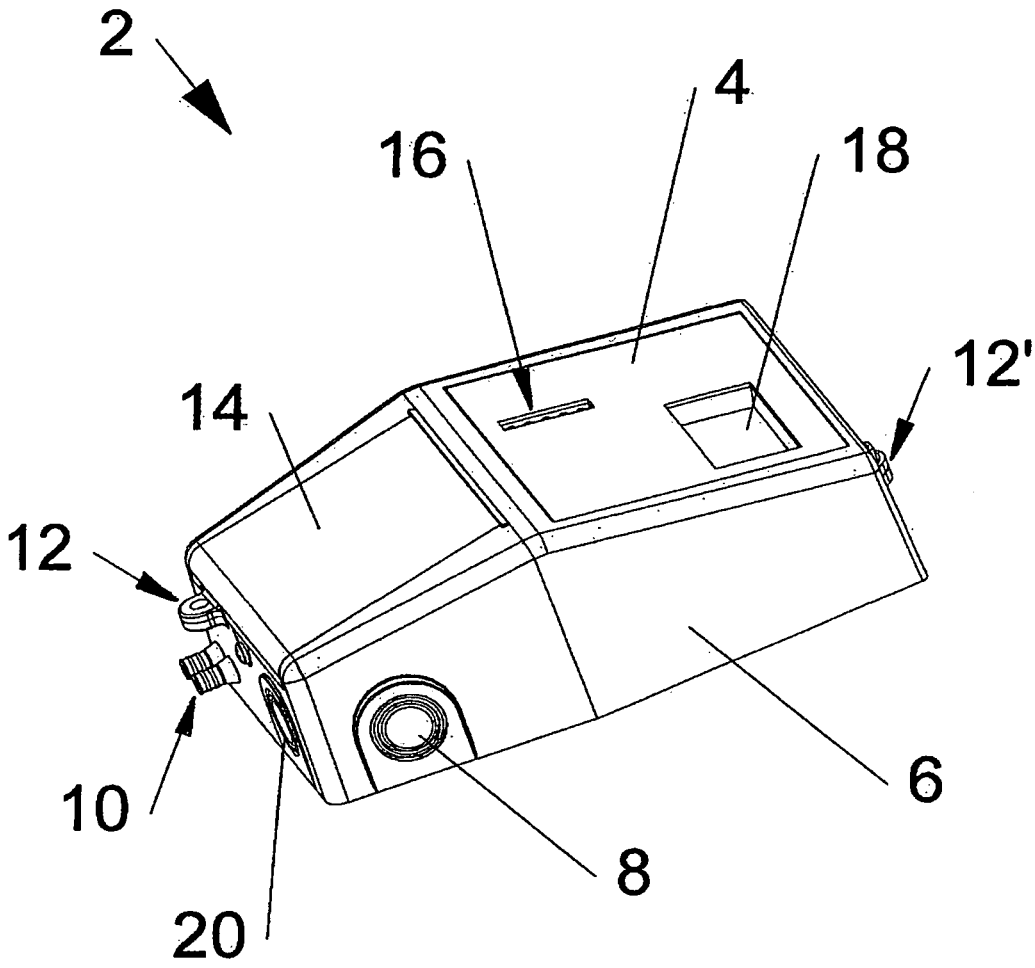
FIG. 1 is a perspective view of the most preferred embodiment of the present invention from one of its sides and showing a main cover having a keypad area and a separable relay cover.
Figure 2:
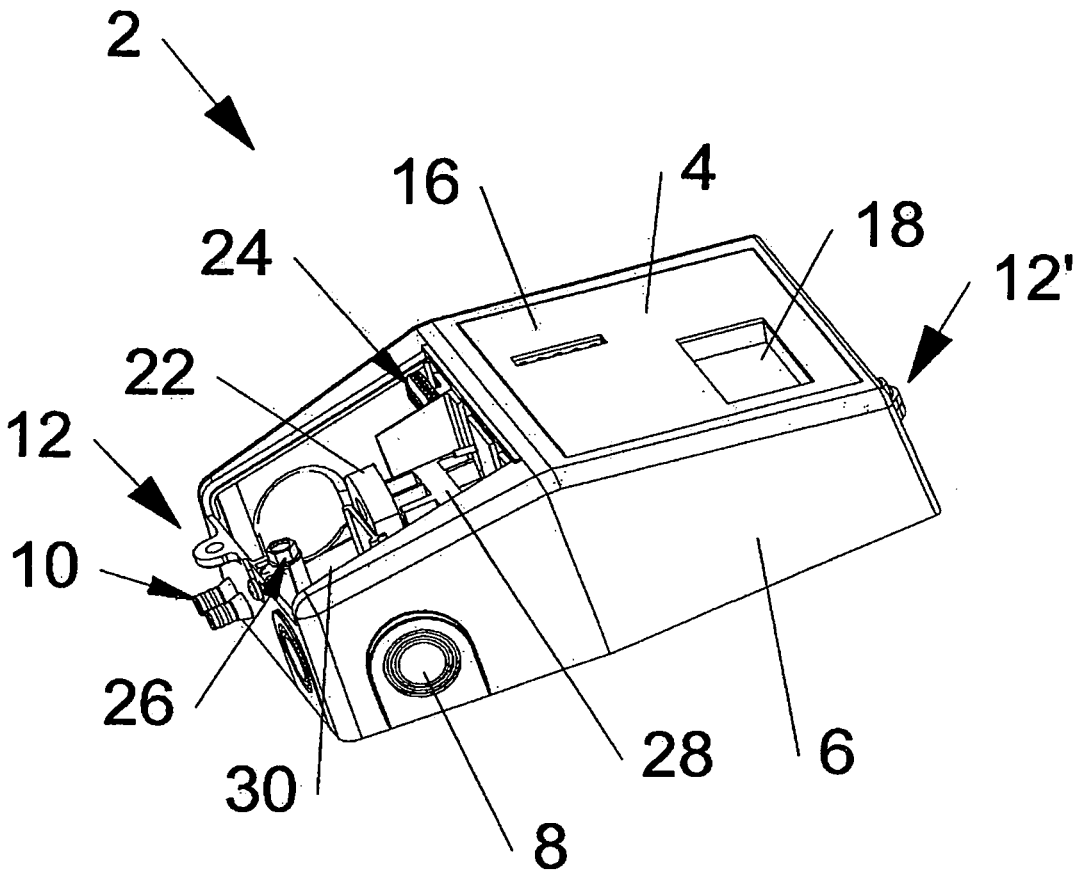
FIG. 2 is a perspective view of the most preferred embodiment of the present invention from the same side as is shown in FIG. 1, without its relay cover.
Figure 3:
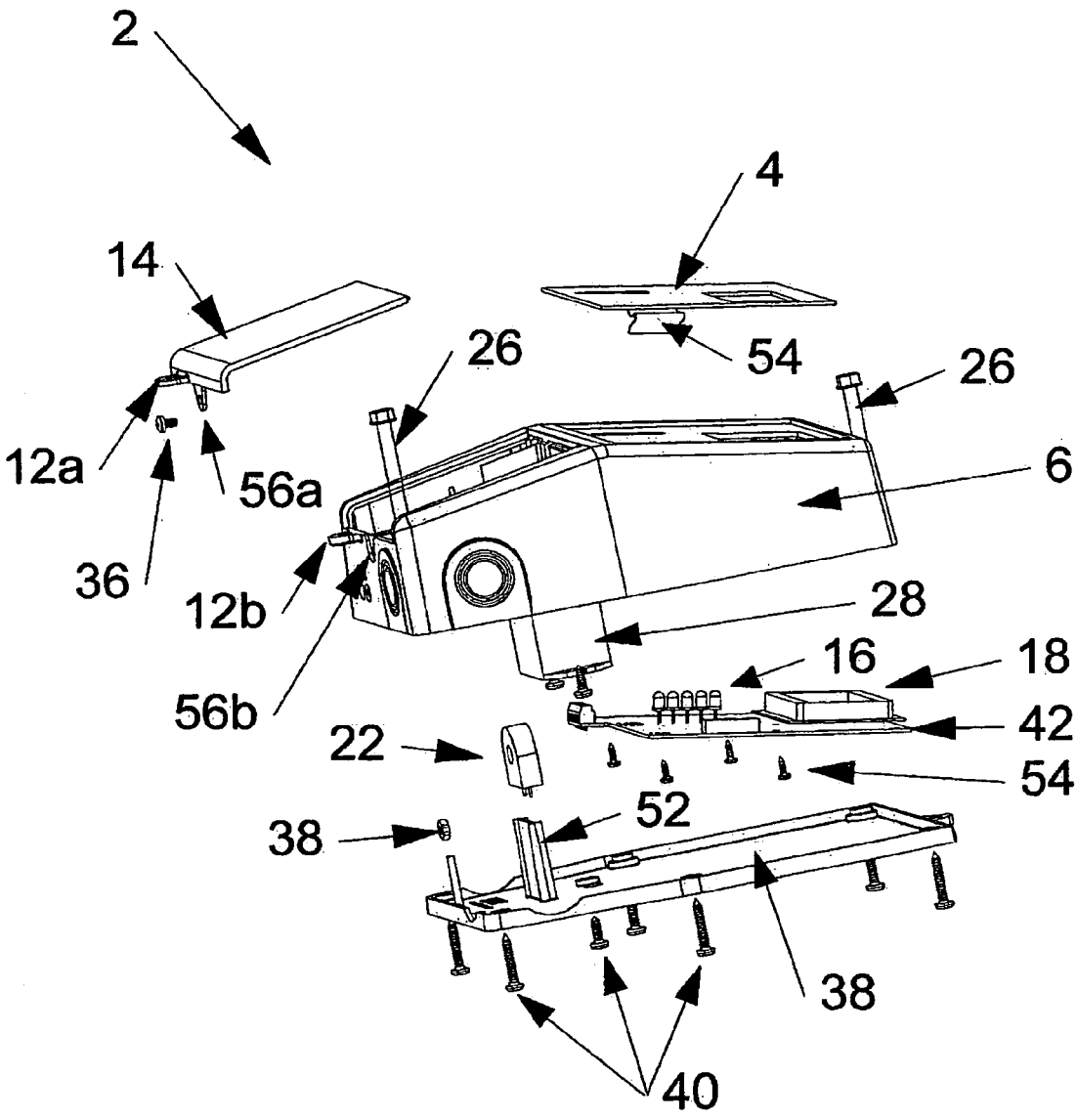
FIG. 3 is an exploded view of the most preferred embodiment of the present invention showing a keypad cover and a relay cover above the main cover, with a flexible header below the main cover and a base positioned below the flexible header, and further with various fasteners and other components generally located close to their intended positions of use.
Figure 4:
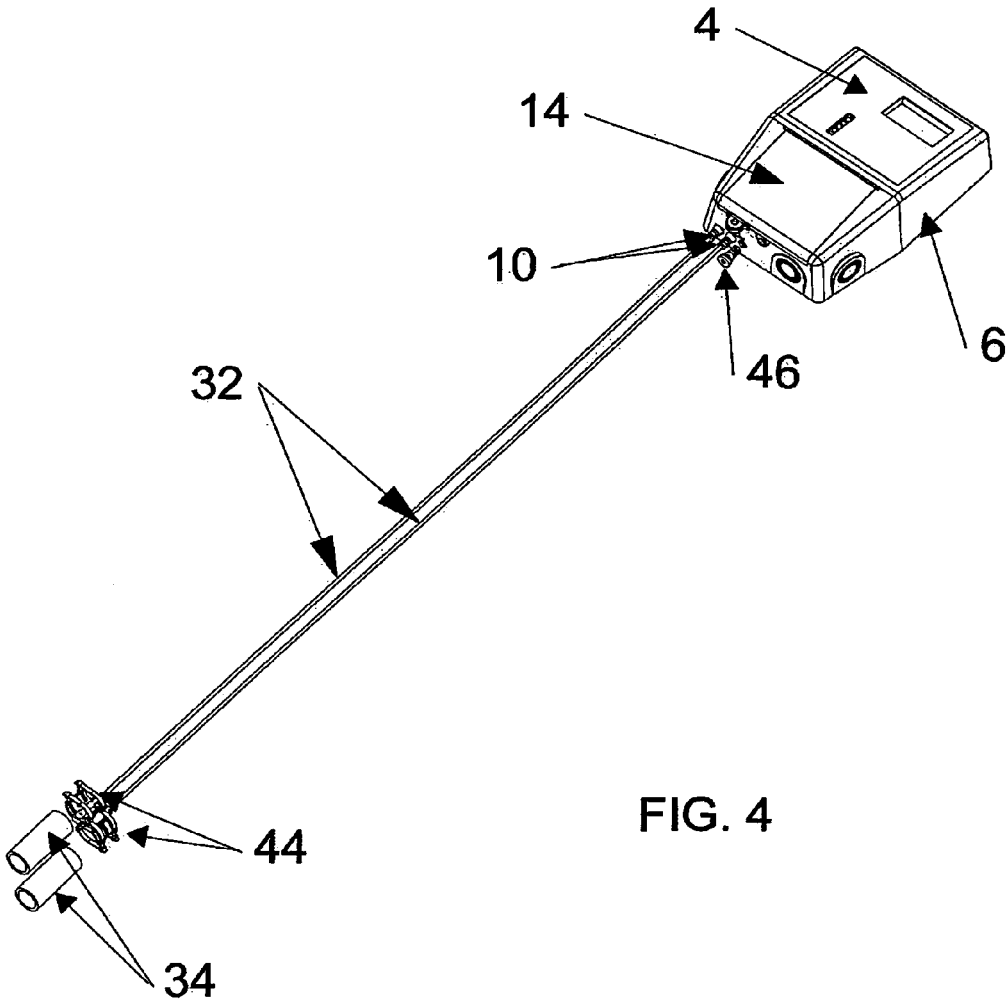
FIG. 4 is a perspective view of the most preferred embodiment of the present invention having two cables each extending between the main cover and different pipe connector, two grommets facilitating connection of the cable through the main cover and two pipe segments each adjacent to a different one of the pipe connectors.
Figure 5:
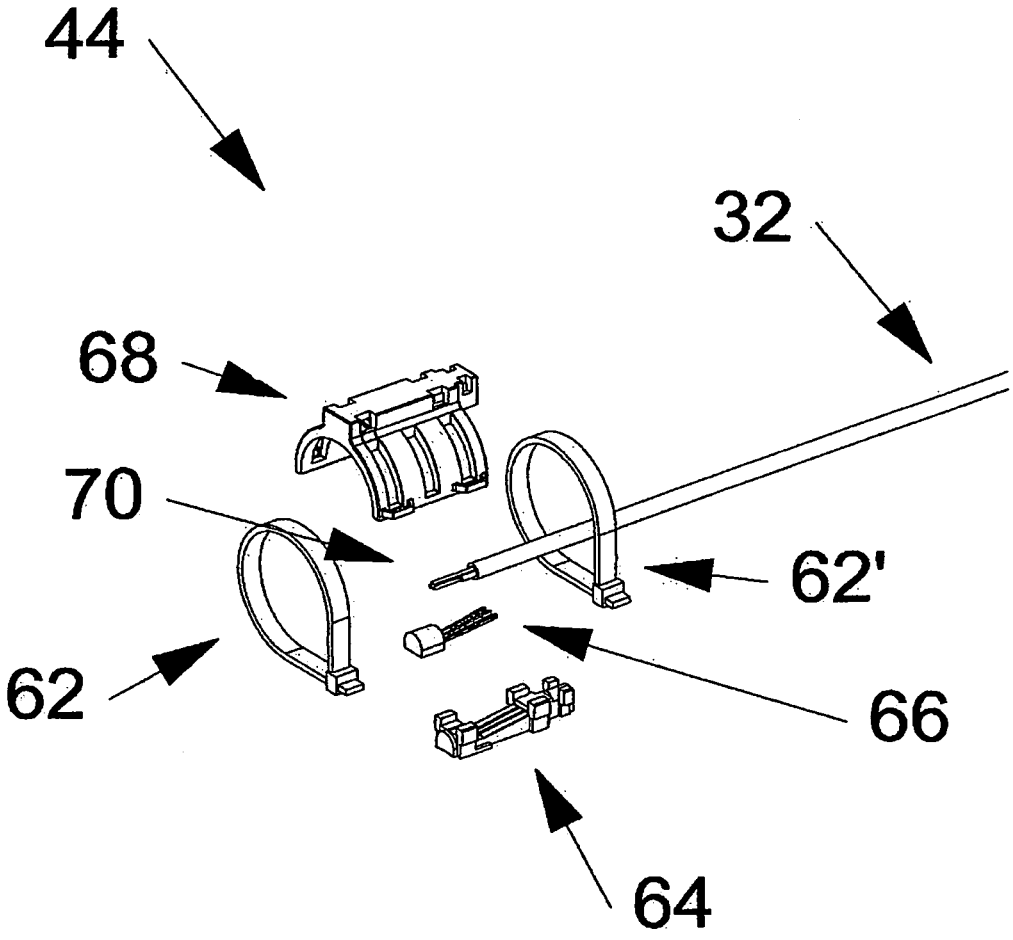
FIG. 5 is an exploded view of a pipe connector that can be used as a part of the most preferred embodiment of the present invention.
Figure 6:
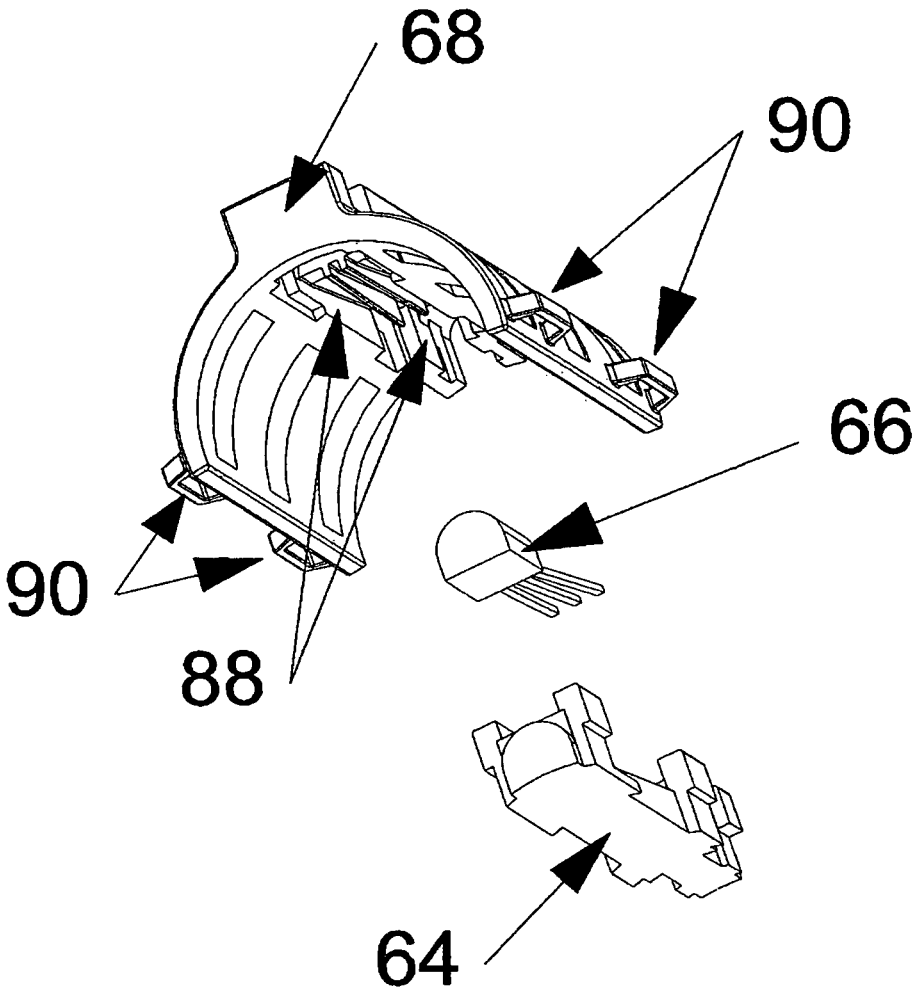
FIG. 6 is an exploded view of a pipe clamp that can be used as a part of the pipe connector in the most preferred embodiment of the present invention.
Figure 8:
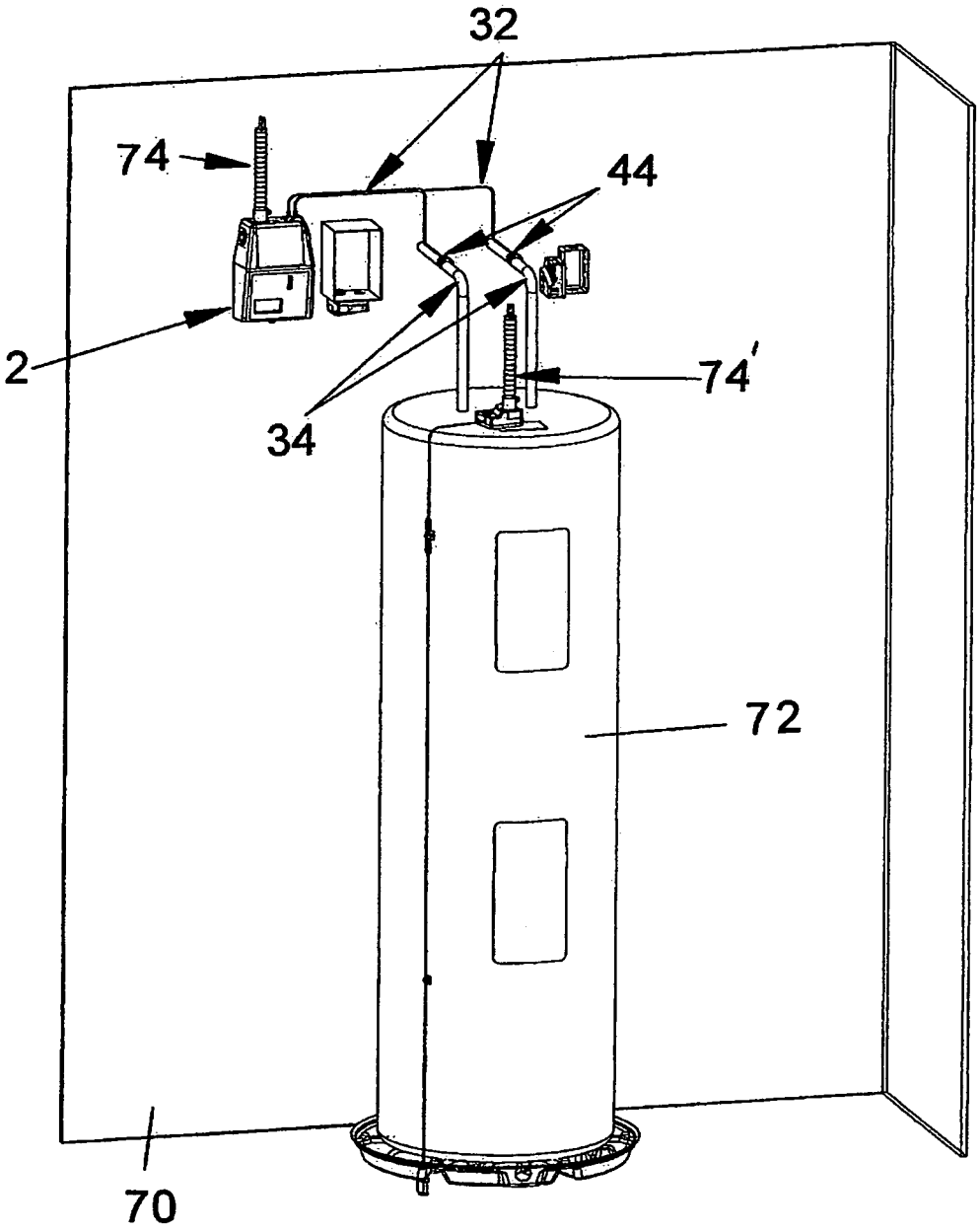
FIG. 8 is a front view of the most preferred embodiment of the present invention connected to an upright storage hot water heater, with its pipe connecters attached to the hot and cold water pipes connected to and servicing the hot water heater.
Figure 9:
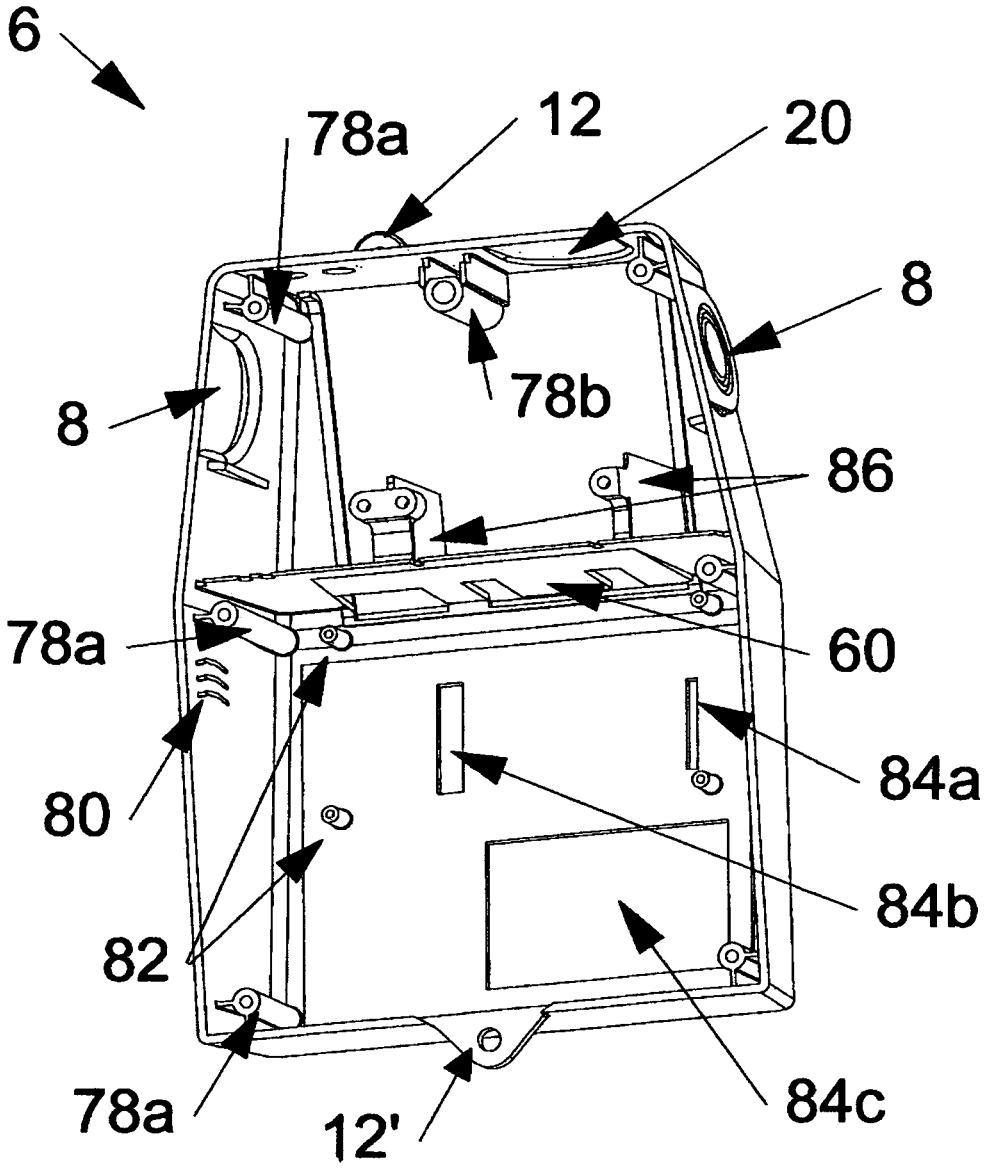
FIG. 9 is a bottom view of the main cover of the preferred embodiment of the present invention showing the mounts for fasteners connecting the main cover and base, the internal wall separating the printed circuit board from the relay compartment, mounts for the relay and the printed circuit board, and several narrow openings grouped together centrally through the side of the main cover.

To accomplish energy savings, the present invention at a minimum would comprise two temperature sensors 66, one that identifies the temperature of the water entering its associated hot water tank 72, and the other identifying the temperature of the water leaving hot water tank 72. As an option, the present invention could also include a flow meter or water level sensor 76. It is considered to be within the scope of the present invention for the internal clock used to account for pre-determined time period, such as a week or a month. However, a vacation mode would not be required, although it could be provided as an option, since the present invention system would shut down hot water production when it senses a lack of hot water usage during periods where demand had previously been present. Although a different time period could be used as a precaution against false activation, in a home having three to four residents, two bathrooms, a kitchen sink, a dishwasher, a washing machine, and a laundry tub, and depending upon its floor plan and whether plumbing fixtures and appliances using hot water are consolidated or not, it is preferred for a time period between approximately fifteen seconds and approximately sixty seconds to be used before any modification to usage patterns is made. It is expected that energy savings provided by the present invention to be approximately 20% to 50% greater than that achievable by demand hot water heating system controlled by a timer. Thus, use of the present invention system will rapidly recoup its cost and installation expense and in most U.S. homes is expected to pay for itself in less than one year. FIGS. 1, 2, and 6 show various views of the present invention activation and energy-savings system 2, while FIG. 3 shows an exploded view and FIG. 9 shows a bottom view of main cover 6. In addition, FIG. 4 shows a present invention embodiment 2 with two temperature sensing cables 32 connected through main cover 6 via grommets 10 for use in monitoring and activating a hot water heater tank. In contrast, FIGS. 5 and 6 show more detail about a preferred temperature sensor contemplated for use as a part of the present invention, while FIG. 8 shows present invention 2 in association with an upright storage hot water heater tank 72.

Figure 7:
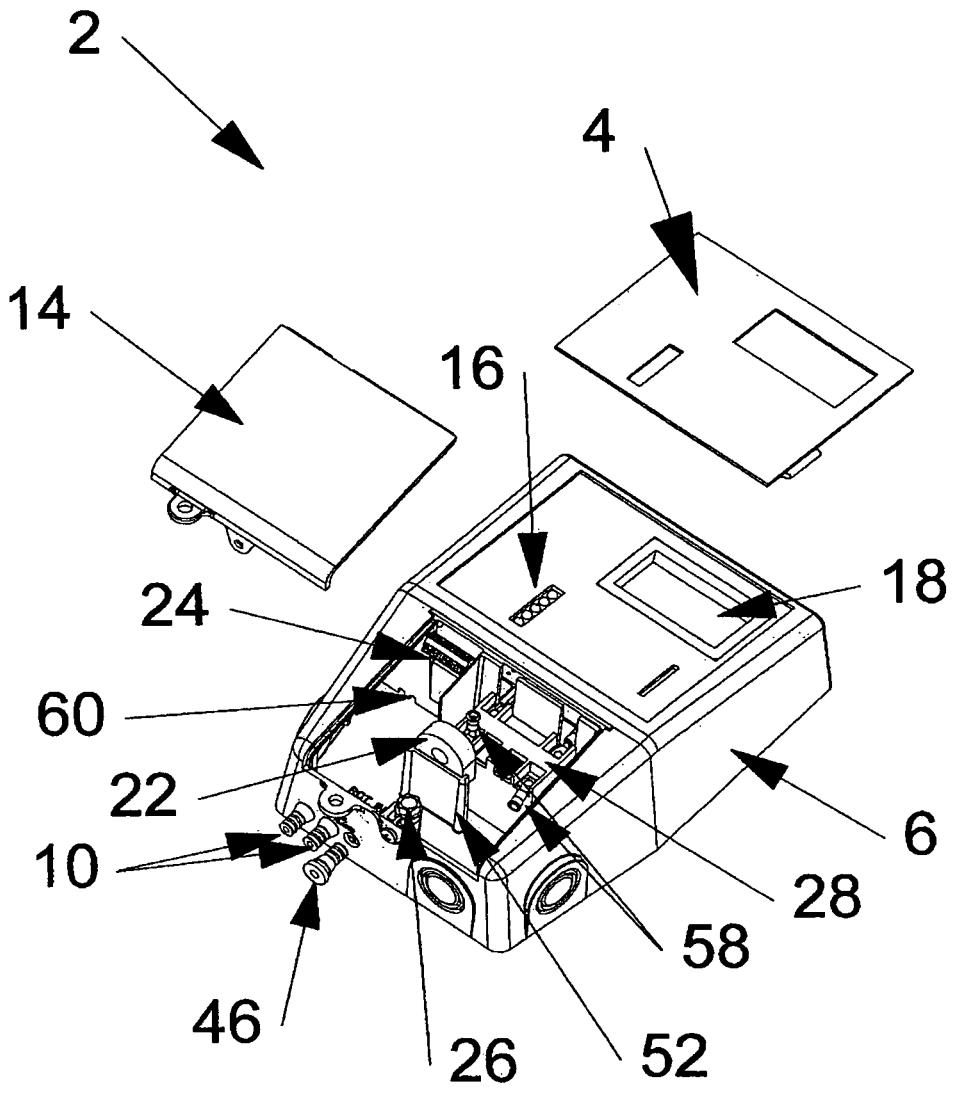
FIG. 7 is an isometric view of the most preferred embodiment of the present invention with its keypad cover and relay cover removed from their positions of use, and showing components housed under the main cover, including a pin terminal block, a relay an amp coil, an LCD display, and LED lights.

FIGS. 1, 2, and 7 show various views of the present invention activation and energy-savings system 2, with FIG. 9 showing a bottom view of main cover 6. FIG. 1 is a perspective view of the most preferred embodiment of the present invention 2 from one side and showing main cover 6 having a keypad cover 4 and a separable relay cover 14. FIG. 1 further shows keypad cover 4 configured to reveal an LCD display 18 and LED lights 16 that may provide information about operating modes and energy savings, as well as other useful information to a viewer. FIG. 1 also shows lock mounts 12 and 12' that can be respectively used to secure the relay compartment 30 (see FIG. 2) and printed circuit board 48 (see FIG. 3) from unauthorized access. FIG. 1 also shows a side knock-out panel 8 and a front knock-out panel 20 that can assist an installer in making needed electrical connections inside main cover 6. As can be seen in FIGS. 2 and 9, a second knock-out panel 8 is contemplated in an opposed position to the one shown in FIG. 1. Furthermore, FIG. 1 shows the grommets 10 used for sealing and protecting the connection of temperature sensing cables 32 (shown in FIGS. 4-5 and 8) through main cover 6. In addition, although unmarked in FIG. 1 (but given the numerical designation of 36 in FIG. 3), positioned above grommets 10 and between lock mount 12 and the front knock-out panel 20 FIG. 1 shows the small fastener that is used to secure relay cover 14 against main cover 6. The perimeter configuration of main cover 6 is arbitrary for purposes of this description, and may be different from that shown in FIG. 1. Also, the locations of LCD display 18 and LED lights 16 are not critical and are not restricted to those shown in FIG. 1. Furthermore, the configurations and locations of lock mount 12 and knock-out panels 8 and 20 may be varied from that shown in FIG. 1 without departing from the intended scope of present invention 2. FIG. 2 is a perspective view of the most preferred embodiment of the present invention 2 from the same side as is shown in FIG. 1, without its relay cover 14, to reveal some of the components shown in FIG. 3, including fastener 26, amp sensor 22, relay 28, and pin terminal block 24. In addition, FIG. 7 shows the mount 52 for current or amperage sensor 22, ring terminals 58 associated with relay 28, and the interior wall 60 separating relay compartment 30 from the adjacent compartment housing printed circuit board 48, in addition to a pool plug grommet positioned to the right of grommets 10 that are used to seal and protect additional electrical connection or connections (not shown) extending through main cover 6. Furthermore, FIG. 9 is a bottom view of main cover 6 of the preferred embodiment of the present invention 2 that reveals more detail about the preferred configuration and positioning of mounts **78*a* and 78*b* for fasteners 26 and 40 (see FIG. 3) that help to securely connect main cover 6 to base 50, the interior wall 60 separating printed circuit board 48 from the relay compartment 30, mounts 86 for securing relay 28 to main cover 6, mounts 82 for securing printed circuit board 48 to main cover 6, and several narrow openings 80 grouped together centrally through the side of main cover 6, which may be used with an audible alarm, if present. Lock mounts 12 and 12' are also shown in FIG. 9, as well as knock-out panels 8 and 20, and in addition three openings 84 are shown in main cover 6 for the compartment housing the printed circuit board 48. The first opening 84***a* through main cover 6 is used for connecting bent tab 54 with flex header 42, the second opening 84*b* is used for viewing a row of LED lights 16 that help to indicate which mode is currently directing present invention 2 operation, and opening 84*c* which is used for viewing and interacting with LCD display 18.

FIG. 3 is an exploded view of the most preferred embodiment of the present invention 2 and shows more detail about preferred components and their preferred positioning in association with main cover 6. As shown in FIGS. 3 and 7, keypad cover 4 and relay cover 14 are both separated from main cover 6 and positioned above it, with the upper portion 12*a* of lock mount 12 shown attached to relay cover 14 and a small fastener 36 adjacent to a small fastener hole 56*a* in relay cover 14. To secure relay cover 14 against main cover 6, it is contemplated for fastener 36 to be inserted through fastener hole 56*a* and also through a paired hole 56*b* in main cover 6, and secured with a small hex nut 38. As best shown in FIG. 2, relay cover 14 can be locked to main cover 6 via use of lock mounts 12*a* and 12*b*, to prevent unauthorized access to relay compartment 30. FIG. 3 also shows the fasteners 26 (preferably self tapping screws, but not limited thereto) that are used respectively with mount 78*b* and lock mount 12' (see FIG. 1, as the lower part of lock mount 12' that is shown in FIG. 3 remains unmarked by numerical designation) to secure base 50 and main cover 6 to the wall or other mounting surface. Positioned below main cover 6, FIG. 3 shows relay 28 with bottom fasteners 40 that secure it to mounts 86 (see FIG. 9) in relay compartment 30 (see FIG. 2), and one ring terminal 58 (only one is used for illustrative purposes) associated with the top portion of relay 28. Between relay 28 and base 50, FIG. 3 shows a printed circuit board having attached LED lights 16, LCD display 18, and flex header 42 (which are all separated from relay compartment 30 by interior wall 60), and pin terminal block 24 which is positioned within relay compartment 30. Several fasteners 40 are located below printed circuit board 48 for attaching it to mounts 82 (see FIG. 9), in addition to a small wire positioned to the right of pin terminal block 24 is also shown extending from printed circuit board 48. Base 50 is positioned in FIG. 3 below printed circuit board 48. Base 50 is shown having a mount 52 for the current sensor 22 located immediately above mount 52, and FIG. 3 also shows multiple fasteners 40 positioned below base 50 that are used to secure it to main cover 6 via the mounts 78*a* shown in FIG. 9. The number of LED lights 16 may be different from that shown in FIG. 3, and the positioning of components on printed circuit board 48 are not limited to that shown in FIG. 3, except for pin terminal block 24 that is housed within relay compartment 30. Although the lower portion of lock mount 12' (see FIG. 1) is visible on one end of base 50 in FIG. 3, it remains unmarked by any numerical designation.

FIG. 4 discloses two temperature sensing cables 32 for water heater tank 72 including a pipe connector assembly 44 secured to the end of each of the cables 32 and a different grommet 10 facilitating connection of each cable 32 through main cover 6. FIG. 4 shows a pipe segment 34 adjacent to each pipe connector assembly 44, the connection of one to the other being illustrated in FIG. 8, which shows the most preferred embodiment of the present invention 2 connected to an upright storage hot water heater tank 72, with its two pipe connectors 44 respectively attached to the hot and cold water pipes 34 connected to and servicing the hot water heater tank 72. FIG. 8 shows the present invention 2 securely fixed to the wall shown behind hot water heater tank 72 in a position close to hot and cold water pipes 34 with cable 74 connected to a flow meter or water level sensor 76. Although a water collection pan and electrical connection between flow detectors or water level sensor 76 and a water detection switch associated with the pan are also in FIG. 8, they will not be claimed as a part of the present invention and have not been marked with numerical designation. FIG. 5 presents an exploded view of a pipe connector assembly 44 that can be used as a part of the most preferred embodiment of the present invention 2. FIG. 5 shows each pipe connector assembly 44 having two flexible tie down straps 62 and 62' (preferably made from plastic) that are used to secure a pipe clamp 68 to the water pipe 34 shown in FIGS. 4 and 8. FIG. 6 shows the slots 90 that are typically used to maintain tie down straps 62 and 62' (FIG. 5) in their preferred locations of use around pipe clamp 68. FIGS. 5 and 6 also show temperature sensor 66 and the over-molding 64 used to maintain temperature sensor 66 within the interior compartment 88 in the raised top/center portion of pipe clamp 68 so that temperature sensor 66 can be held closely against a water pipe 34 to monitor changing water temperatures within water pipes 34. The sensing of changes in water temperature flowing through the water pipe 34 indicates water flow therethrough.

Use of the present invention for saving energy in hot water heater tank 72 operation involves the use of various distinct modes including a mode that records patterns of hot water usage and then creates on a moving average of historical data to predict hot water demand.

The operation of the energy conservation system is best understood with reference to FIGS. 10 through 21.

Figure 16:
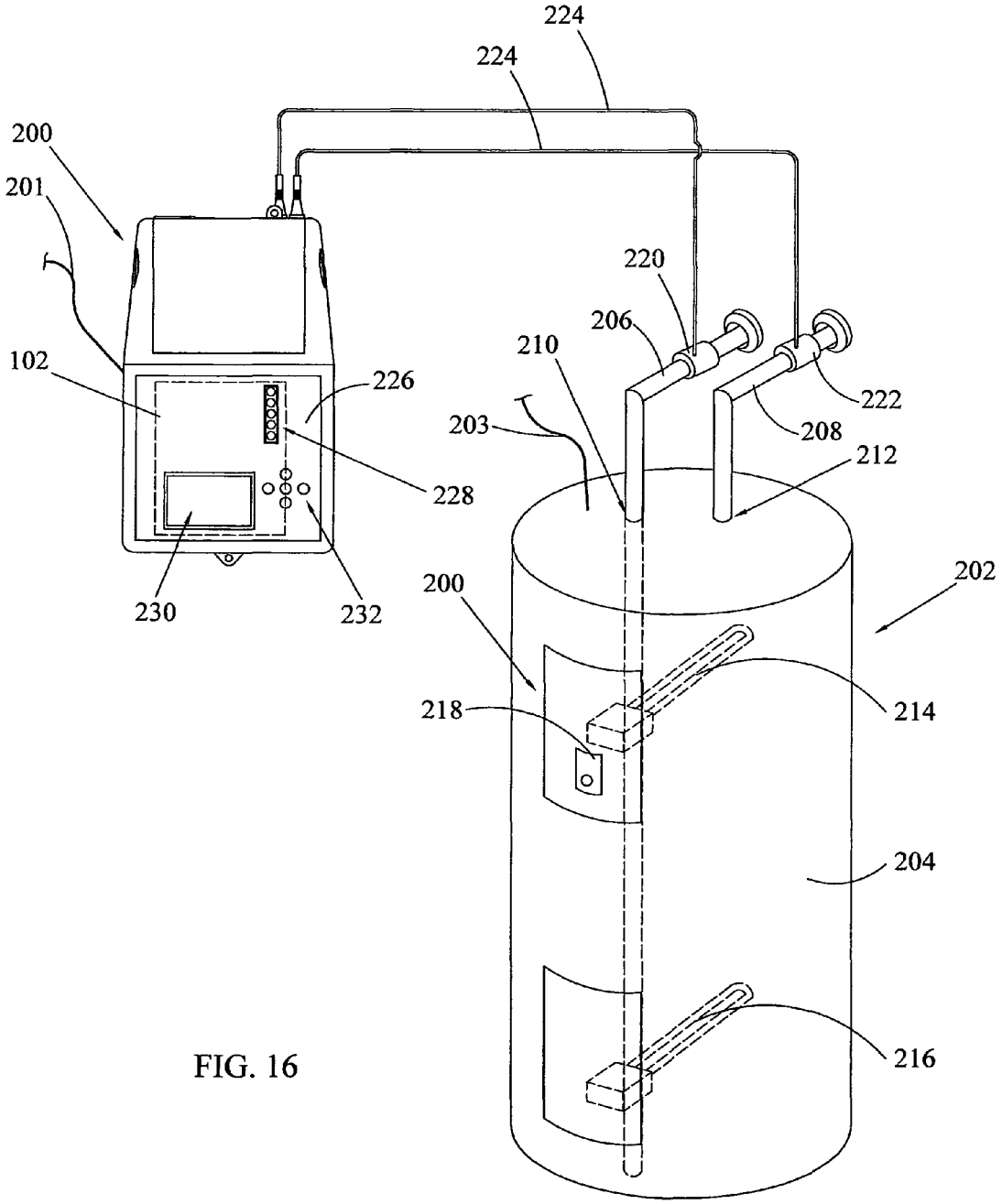
FIG. 16 depicts the energy conservation system of the present invention and a water heater.

FIG. 16 shows a system display and control enclosure generally indicated as 200 connected to an external power source (not shown) by a conductor 201 to house the control and display system in combination with a water heater generally indicated as 202 connected to an external power source (not shown) by a conductor 203 including a water storage tank 204 having an inlet pipe 206 and an outlet pipe 208 in fluid communication with the interior of the water storage tank 204 through an inlet port 210 and an outlet port 212 respectively, an upper heat element 214 and a lower heat element 216 and a thermostat 218. An inlet water temperature sensor 220 and an outlet water temperature sensor 222 coupled to the enclosure 200 by signal transfer cables 224 are disposed in heat transfer relationship relative to the inlet pipe 206 and the outlet pipe 208 respectively to sense the cold water temperature and hot water temperature respectively and to generate and transmit signals corresponding to the cold water temperature and the hot water temperature to the microprocessor 102.

The system display and control enclosure 200 includes a front display panel 226 comprising an LED window 228 to display the LEDs, an LCD window 230 to display the LCDs and a plurality of system control buttons or keys generally indicated as 232.

Figure 10:
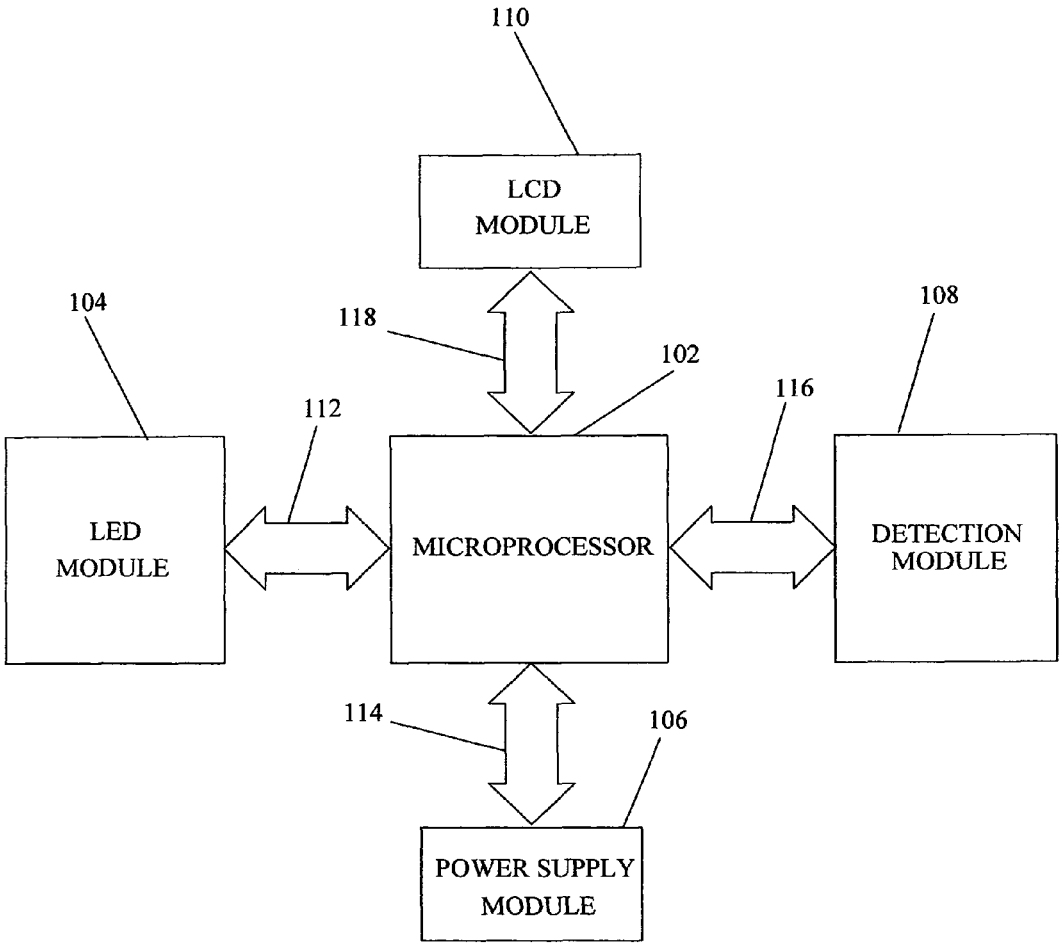
FIG. 10 is a block diagram of the control and display system of the present invention.

FIG. 10 is a block diagram of the control and display system of the present invention. Specifically, the control and display system comprises a microprocessor 102 having logic and circuitry to control the operation of the various components of the present invention including an LED module 104, a power supply module 106, a detection module 108 and an LCD module 110, each coupled or interconnected to the microprocessor 102 by a corresponding cable or a plurality of signal conductors indicated as 112, 114, 116 and 118 respectively.

Figure 11:
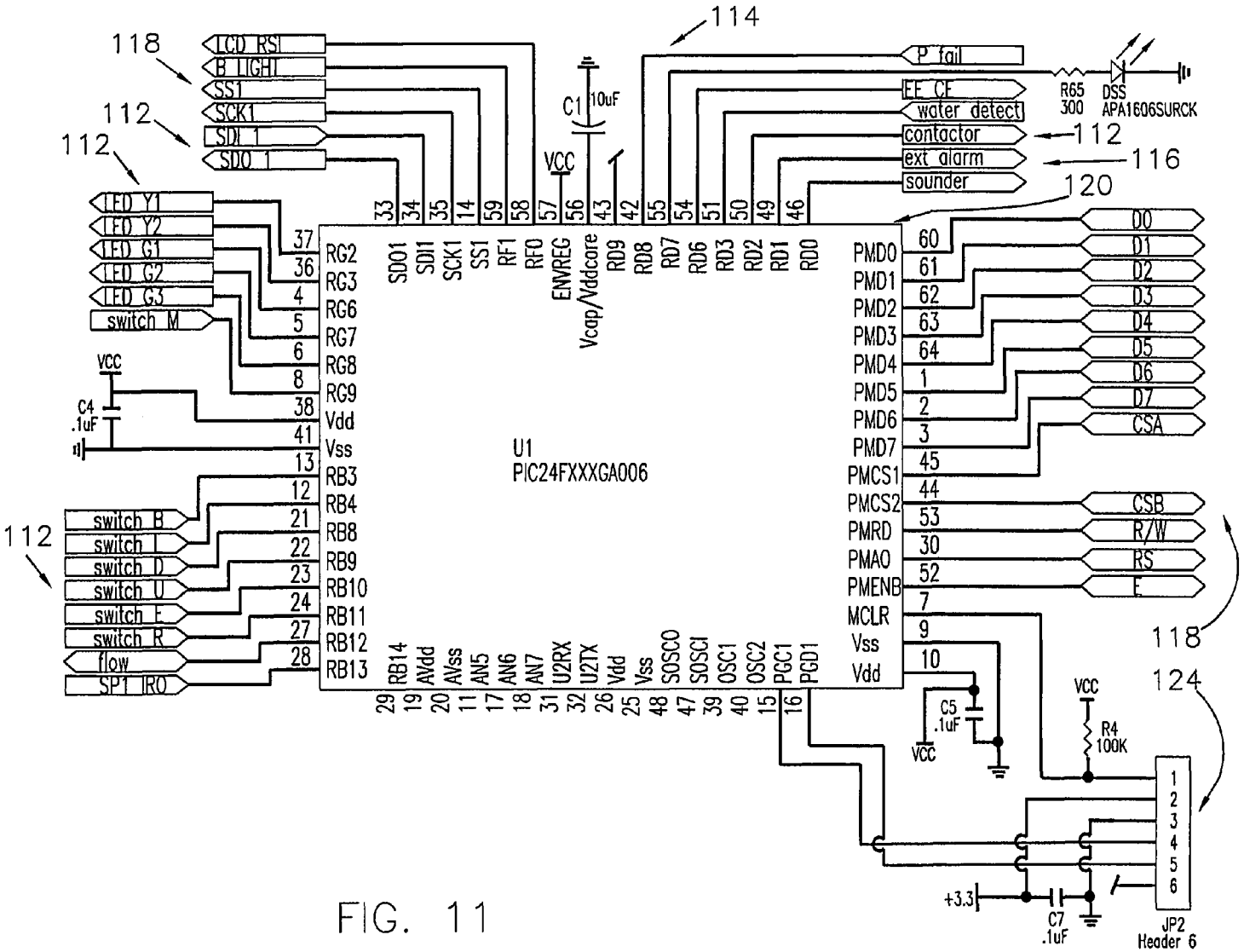
FIGS. 11 and 11A depict a schematic of the microprocessor of the present invention.
Figure 11A:
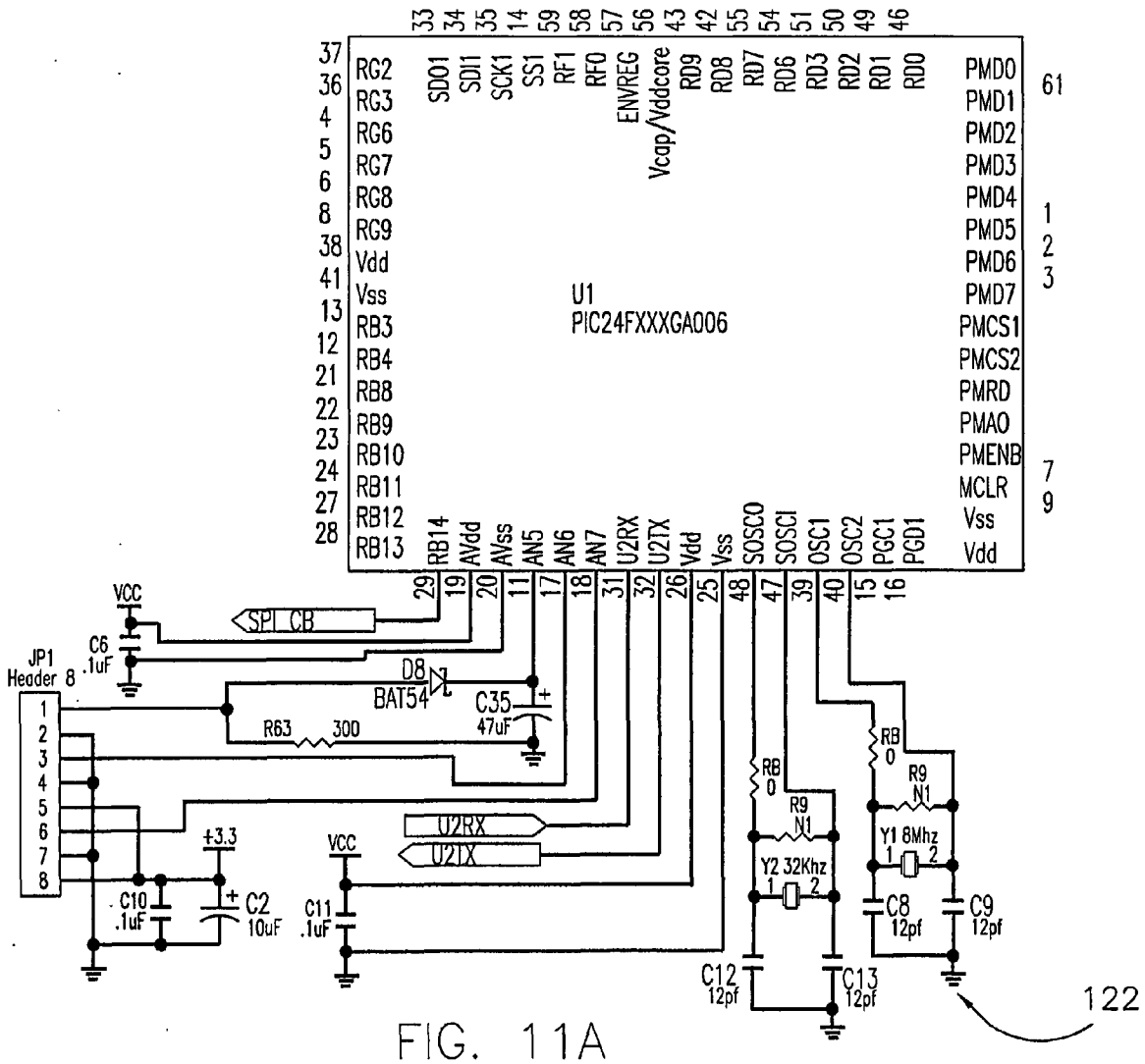
Figure 12A:
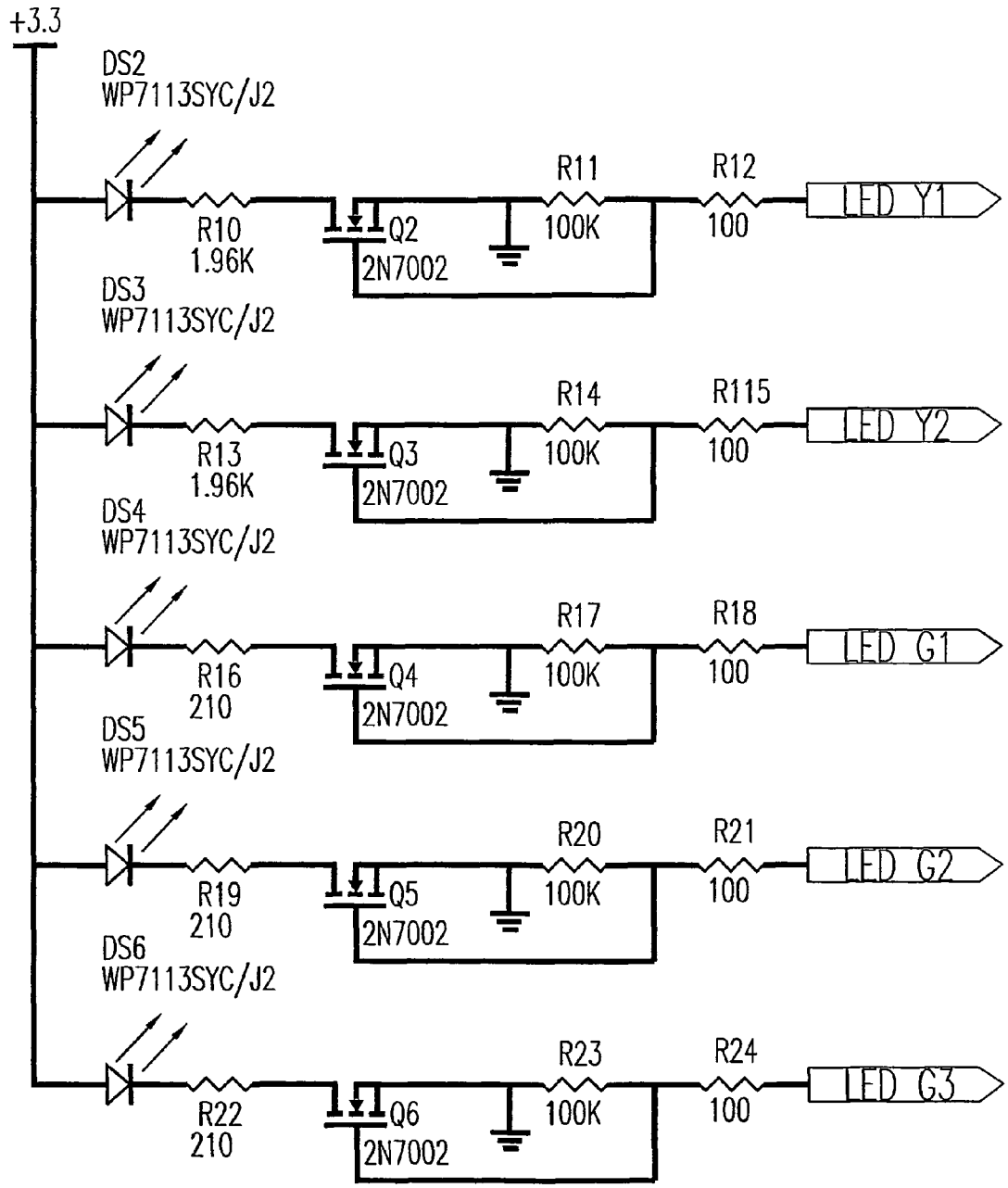
FIGS. 12A through 12D are a schematic of the LED module of the present invention.
Figure 12B:
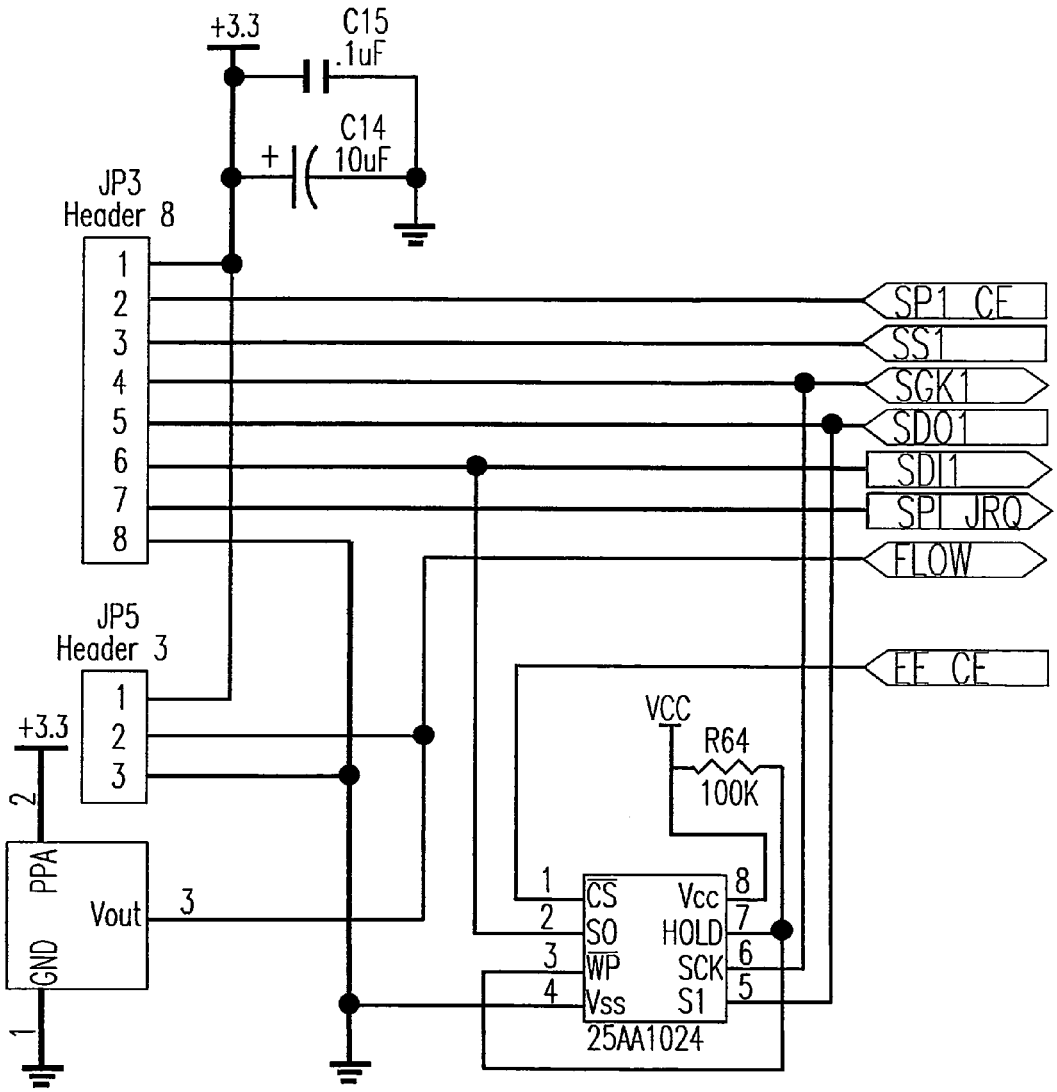
Figure 12C:
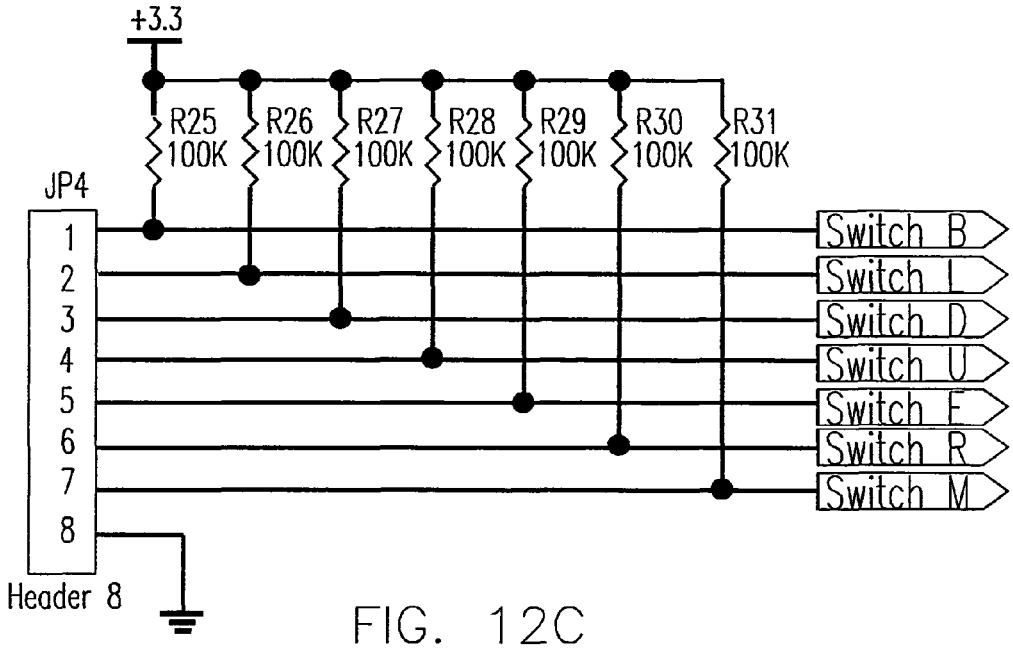
Figure 12D:
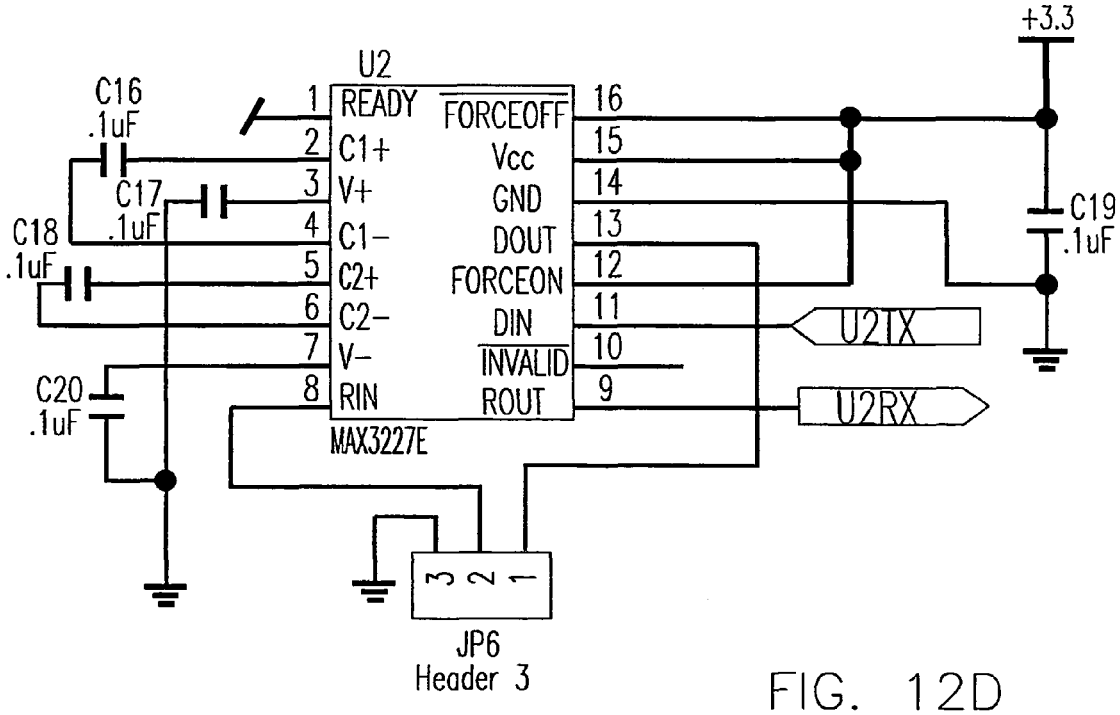
Figure 13A:
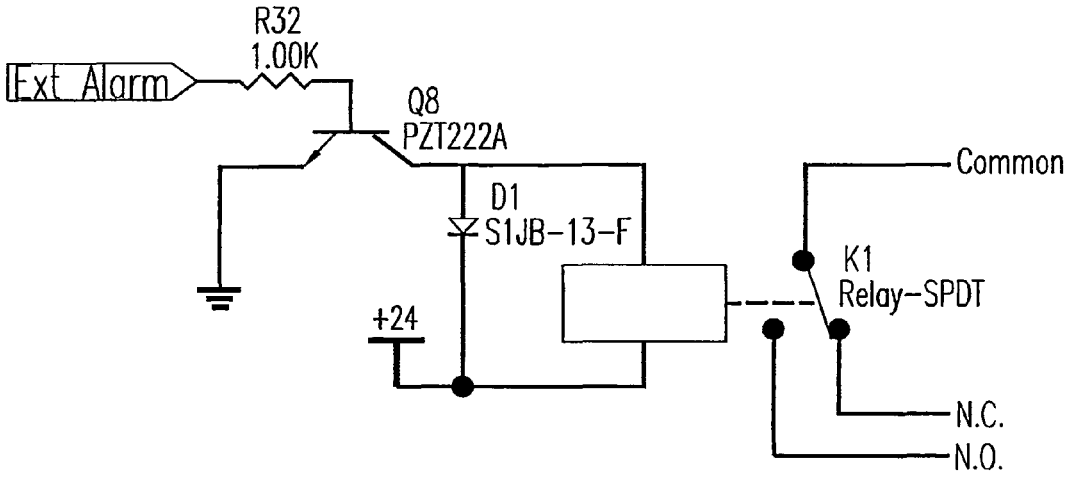
FIGS. 13A through 13E are a schematic of the detection module of the present invention.
Figure 13B:
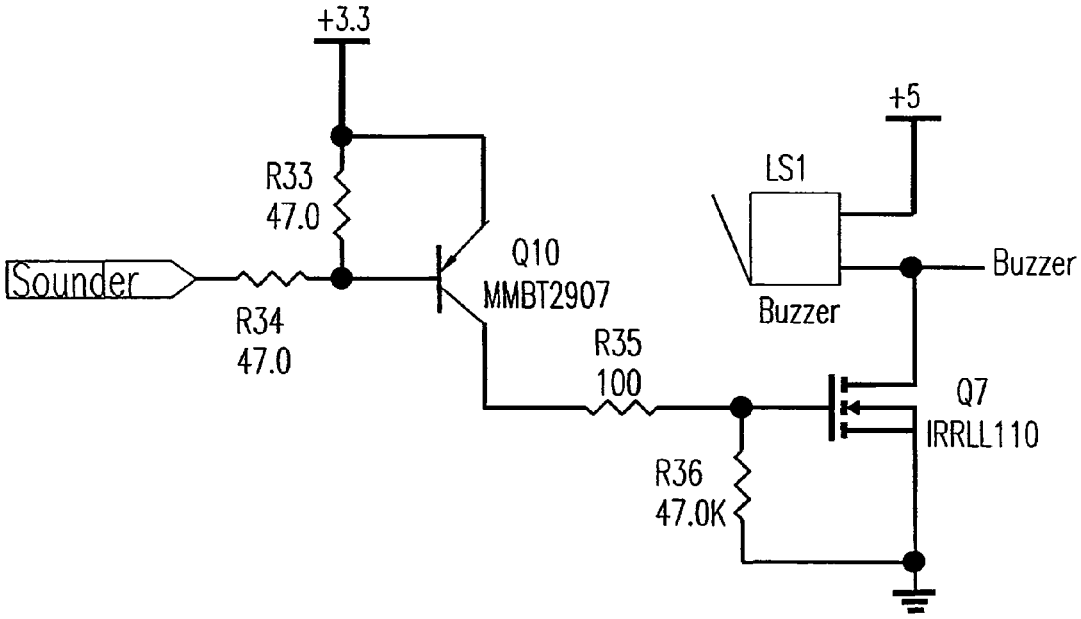
Figure 13C:
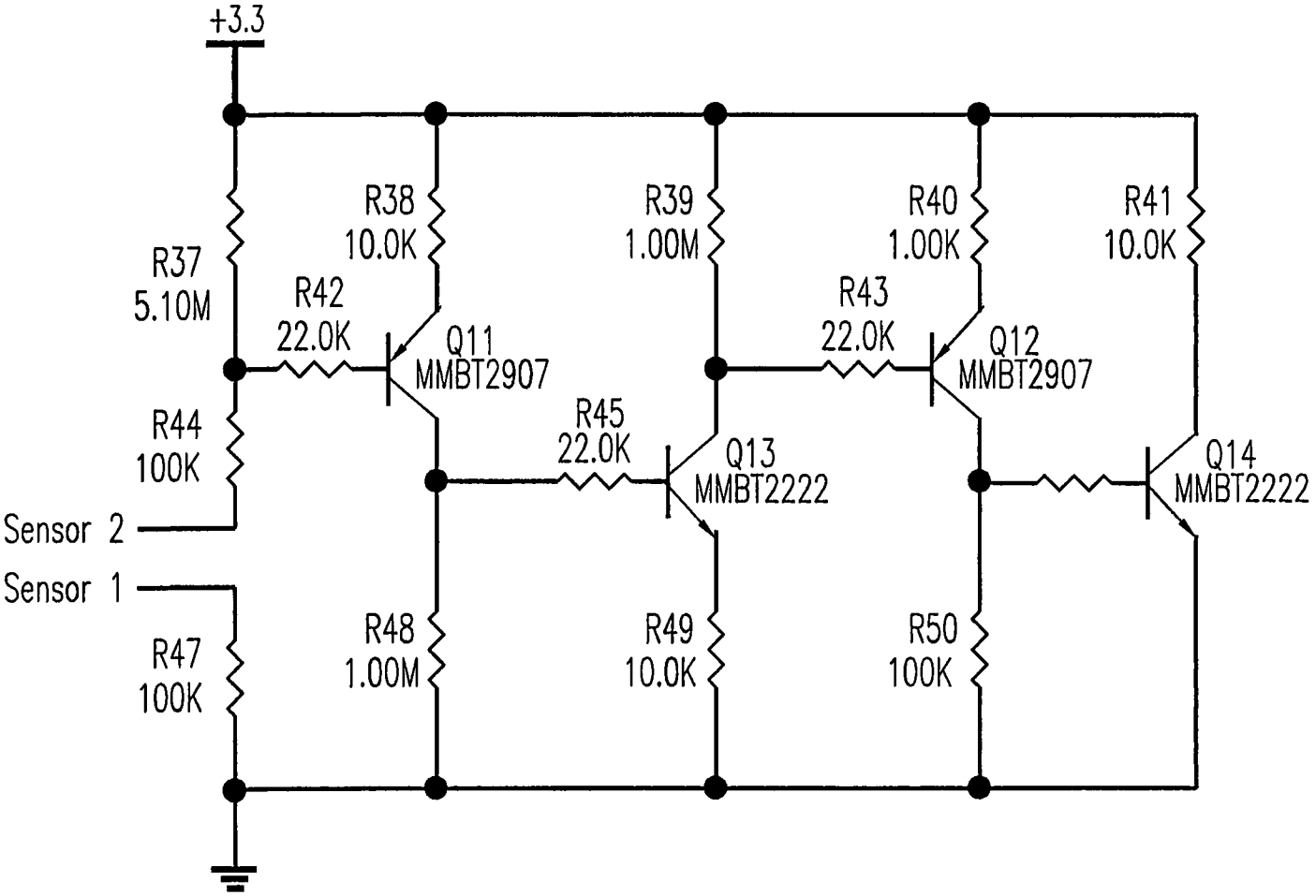
Figure 13D:
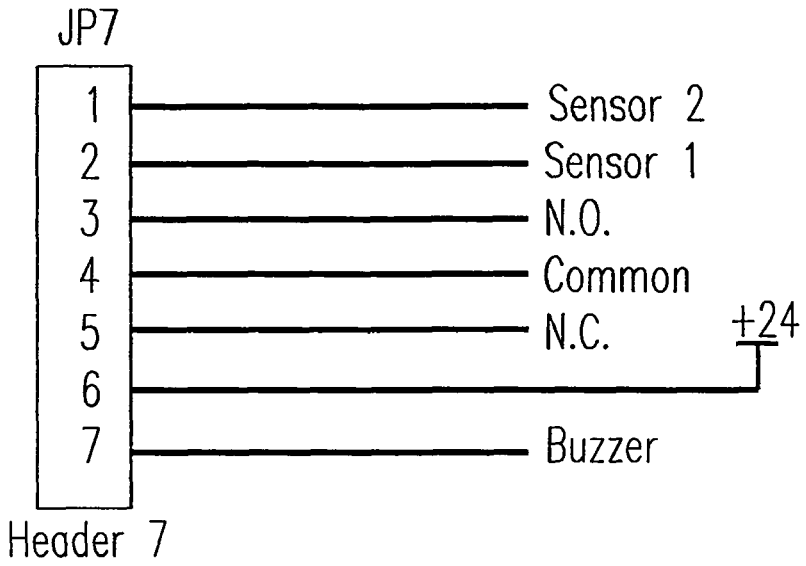
Figure 13E:
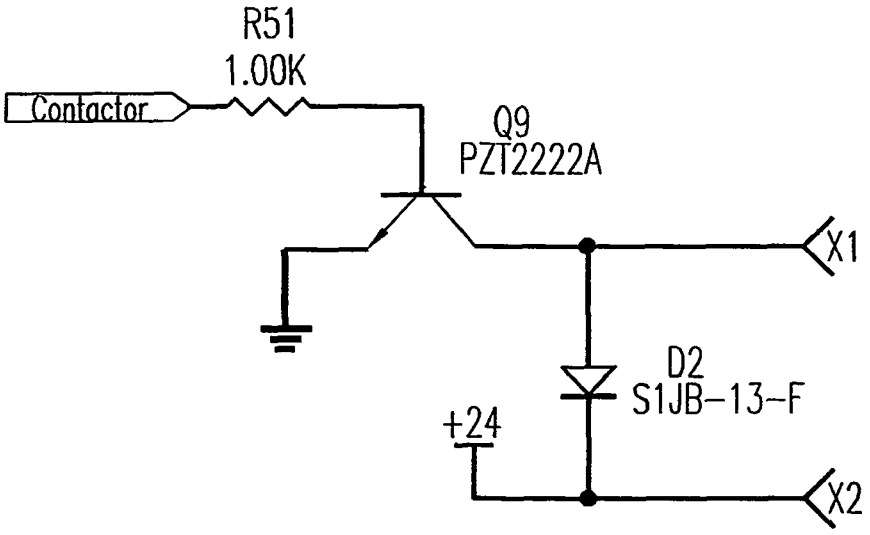

FIGS. 11 and 11A show a schematic of the microprocessor 102 including a microcontroller 120, high and low frequency timing crystal oscillators 122, programming and debug connection or bus 124 and visible LED. The microcontroller 120 performs the logical sequence to operate the input and output circuitry and the various devices including the LED module 104, the power supply module 106, the detection module 108 and the LCD module 110 as shown in FIG. 10.

Together, FIGS. 12A through 12D are a schematic of the LED module 104 including five discrete LED displays with drive circuitry, input switches interface circuitry, EIA RS-232C compliant asynchronous serial data port interface, EEPROM nonvolatile memory and temperature sensor. The LEDs are controlled by outputs from the microprocessor 102. The input switch signals are pulled-up and supplied inputs to the microprocessor 102. The external computer RS-232 connection port interface receives and transmits asynchronous serial data with the control module and microprocessor 102. A serial peripheral interface "SPI" communicates with EEPROM nonvolatile memory IC and expansion header using data, clock and control signals. A temperature sensing IC outputs analog temperature signal to the microprocessor 102.

Together, FIGS. 13A through 13E are a schematic of the detection module 108 including a high gain and high input impendence water detection circuitry, relay and drive circuitry, audible buzzer and drive circuitry and contactor driver circuitry. The water sensor signals are input and detected. A water detect signal is generated and supplied to the microprocessor 102. The microprocessor 102 outputs signals to operate the detection module 108.

Figure 14A:
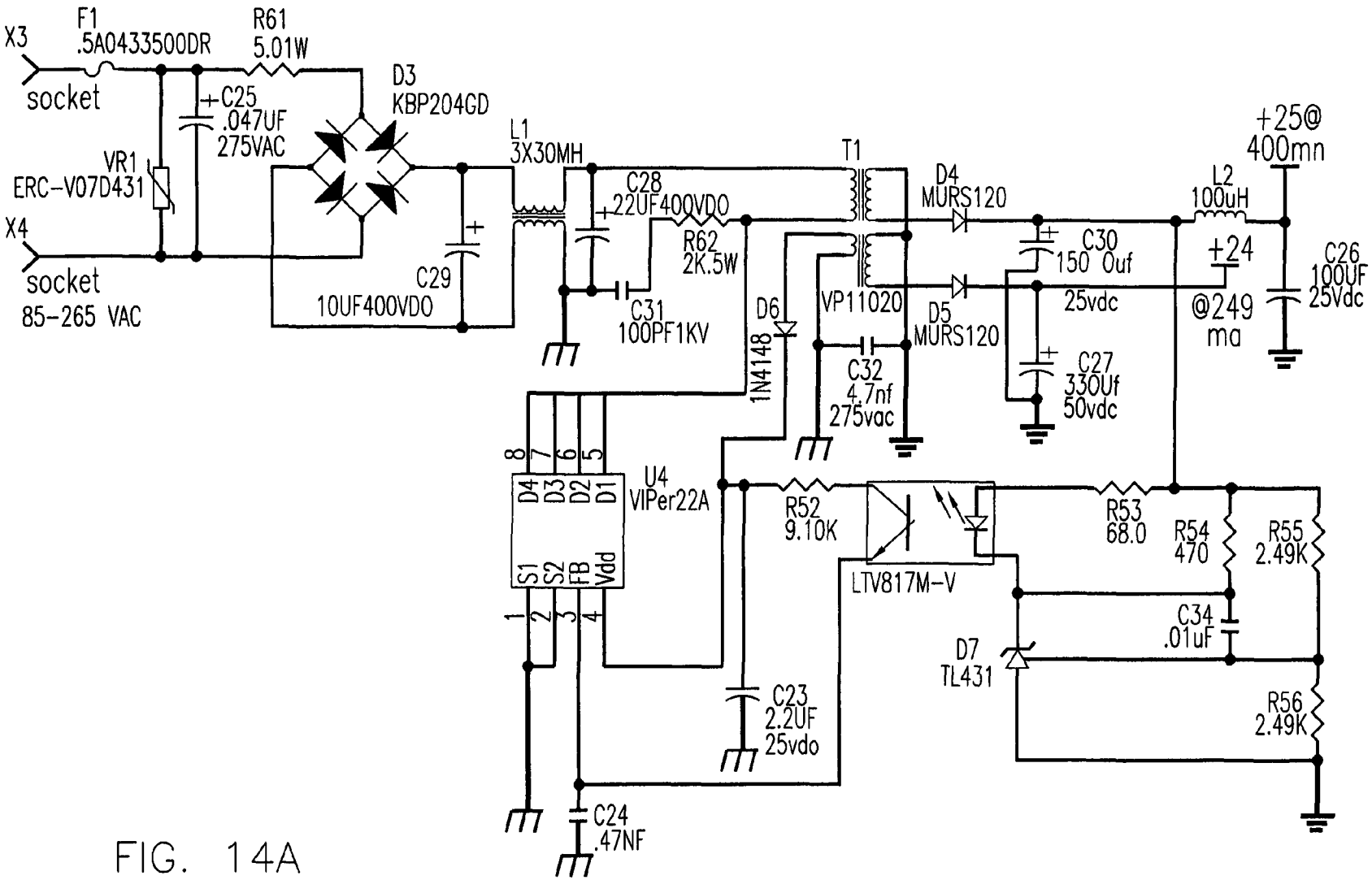
FIGS. 14A through 14C are a schematic of the power supply module of the present invention.
Figure 14B:
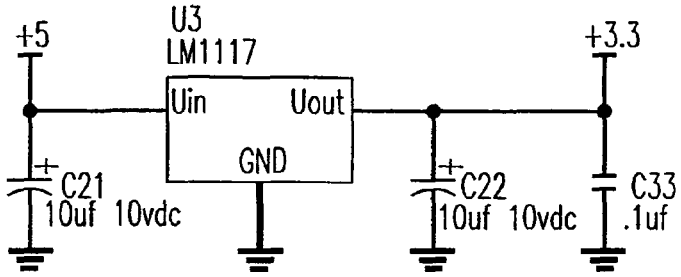
Figure 14C:
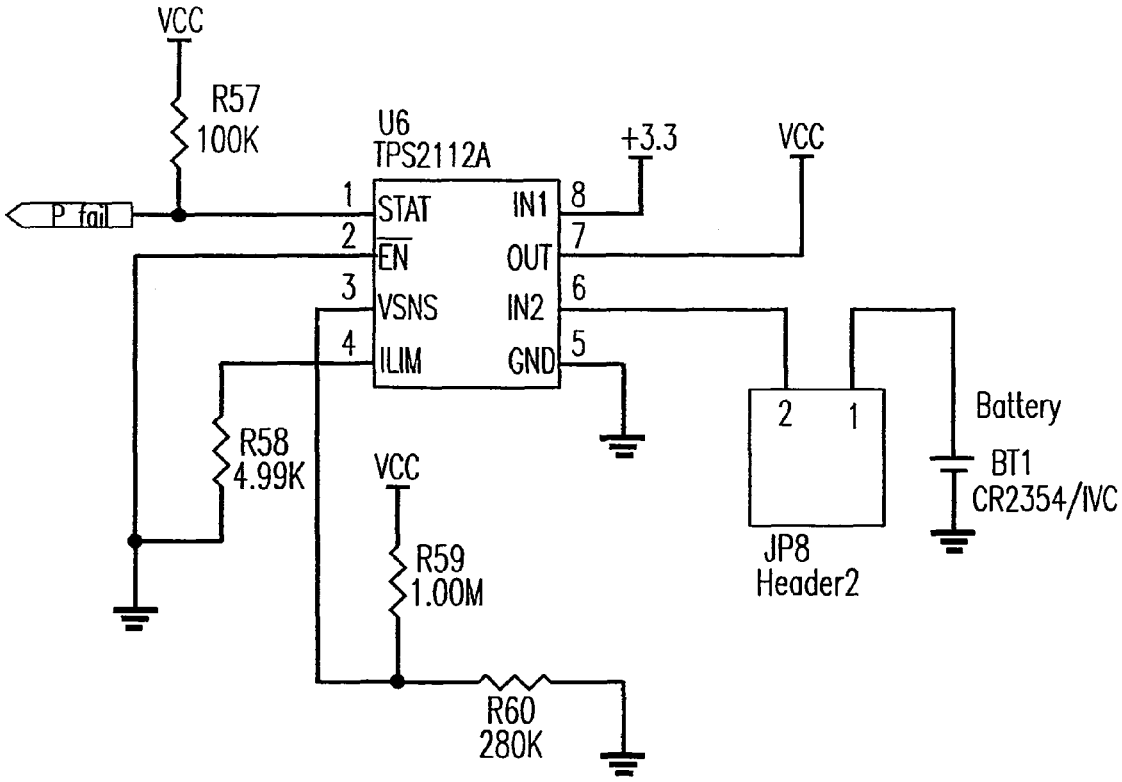

Together, FIGS. 14A through 14C are a schematic of the power supply module 106 including off-line power supply converting 85 Vac to 265 Vac to isolated 24 Vdc and 5 Vdc, 5 Vdc to 3.3 Vdc linear regulator and a battery and auto-switching power multiplexer. The inputs from the 85 Vac to 265 Vac of 24 Vdc and 5 Vdc, and 3.3 Vdc to hot water heater timer circuitry. The battery supplies back-up power of 3.3 Vdc. The power multiplexer generates a Vac power failure power status signal fed to the microprocessor 102.

Figure 15:
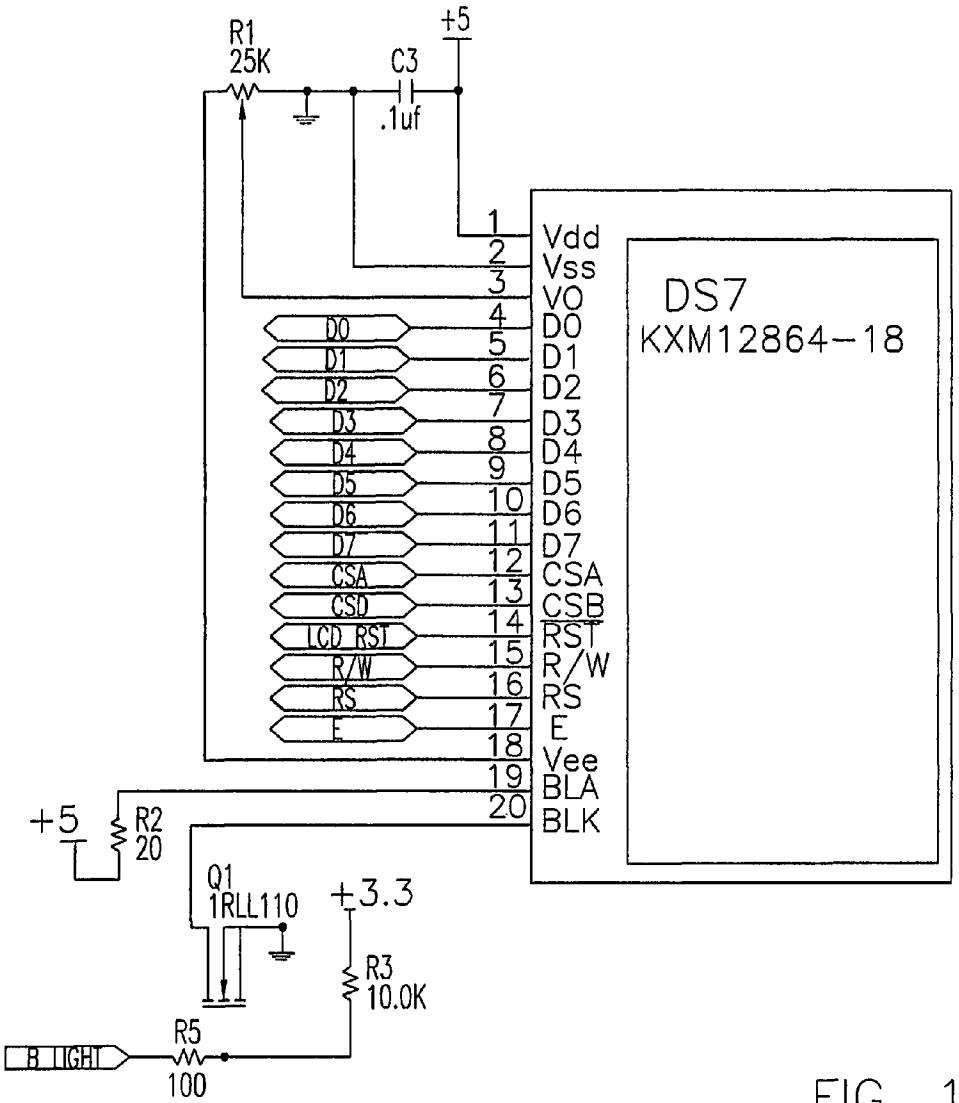
FIG. 15 is a schematic of the LCD module of the present invention.

FIG. 15 is a schematic of the LCD module 110 including an LCD visual display of information on the setup, status and operation of the present invention and a back light drive circuit. The LCD module 110 is controlled by the microcontroller 102 over an eight bit parallel data bus with flow control signals. the LCDs display information such as water pressure, water temperature, current time, current date, recent use for designated time period—week, month, and/or year, and savings in $ or BTUs.

The energy conservation system measures flow events from the water storage tank 206 with respect to time, day and duration to derive demand for hot water and predict future usage patterns taking into account for variations in time of usage from the actual demands due to habits of the user(s) schedule.

The closer the inlet water sensor 220 and the outlet water sensor 222 is located to the inlet port 210 and outlet port 212 respectively the more accurate the correspondence of the sensed temperature to the temperature of the water storage tank 204. Moreover, and temperature differences due to the placement of the inlet water sensor 220 and the outlet water sensor 222 may be calculated or measured allowing for appropriate correction or adjustment by the microprocessor 102.

Figure 17:
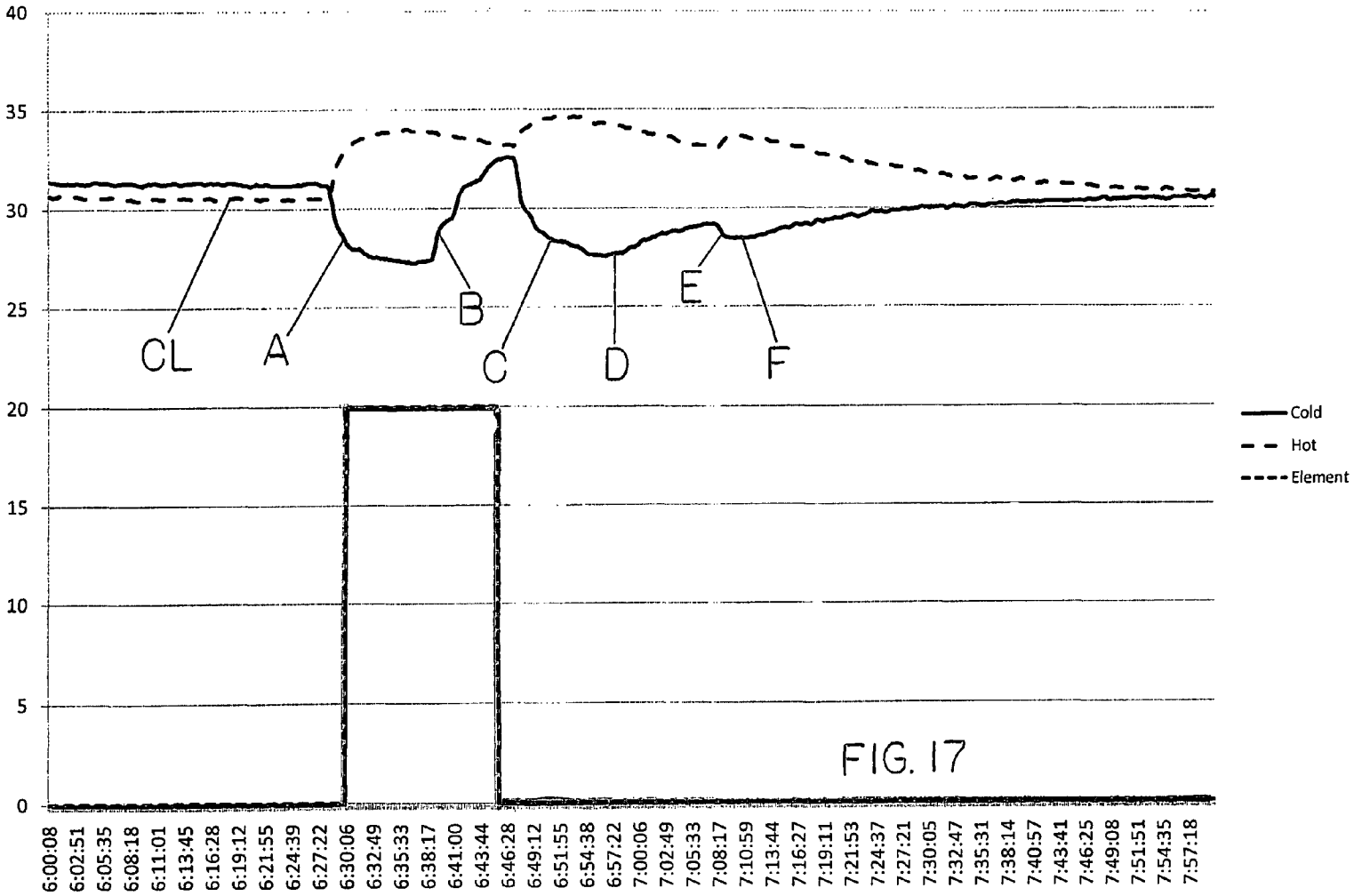
FIG. 17 is a chart of hot and cold water temperatures depicting periods of hot water demand and flow.

Flow events or periods are illustrated in FIG. 17. Specifically, when the temperature of the cold water line CL decreases a predetermined amount such as about 2° as at A indicates the start of flow of hot water from the water storage tank 204 and the increase of the temperature of the cold water line CL as at B indicates a cession of the flow of hot water from the water storage tank 204. The period of time between A and B is the time the hot water is flowing from the water storage tank 204. Since the elapsed period between A and B is more than about two (2) minutes, the microprocessor 102 records a demand for a predetermined maximum quantity for hot water demand or event. When the period or duration between the as the start of another flow of hot water as at C from the water storage tank 204 and the cession of the flow of hot water as at D from the water storage tank 204. Since the D is less than two (2) minutes, the microprocessor 102 records a predetermined minimum quantity for hot water demand or event. The elapsed period or duration of flow of hot water from the water storage tank 204 is less than a minimum period such as about 30 seconds, E to F, no event a demand for hot water is recorded. Of course, changes in temperature on the hot water line HL could also be used to sense, measure and record demands for hot water.

Figure 17A:
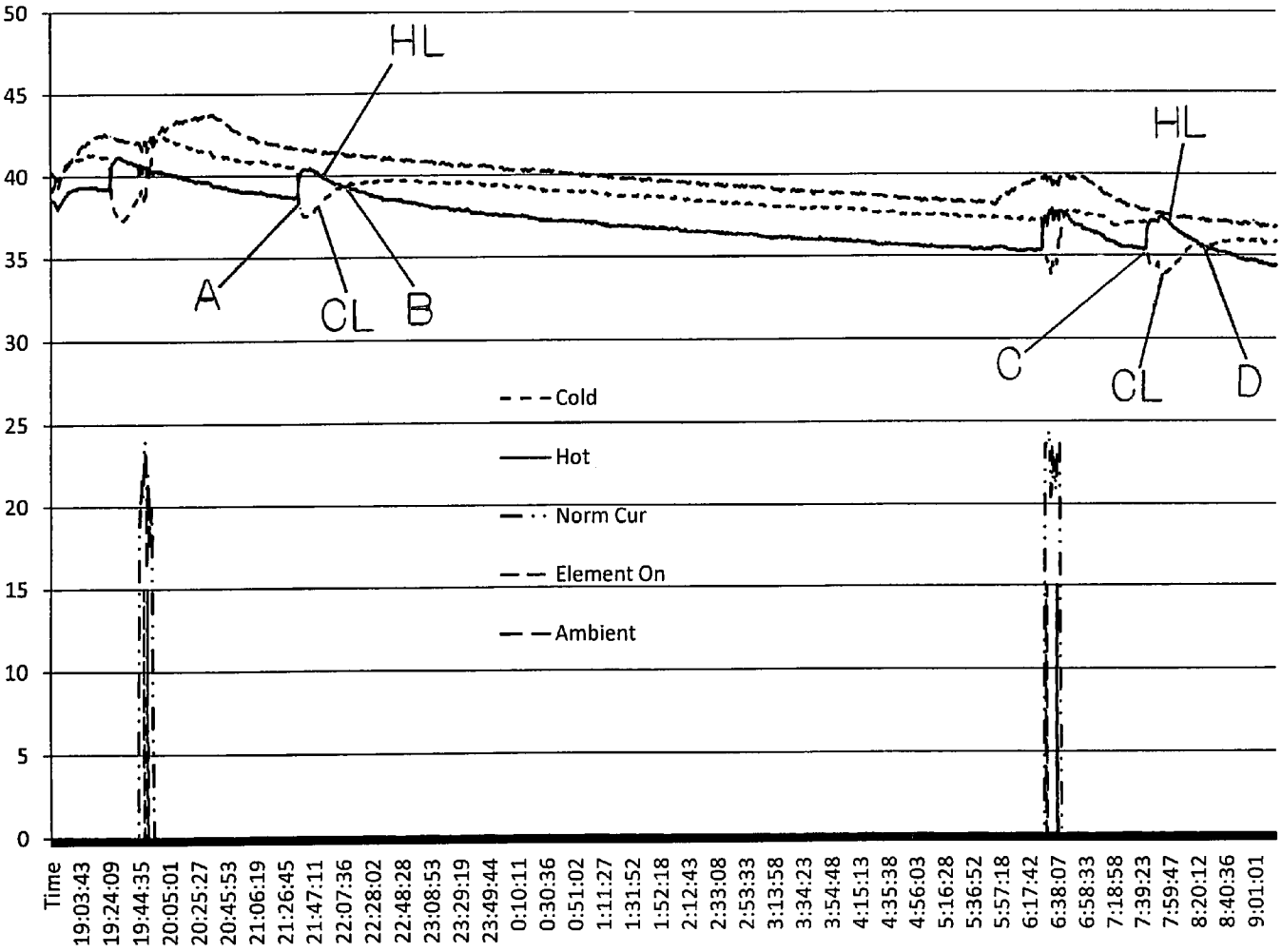
FIG. 17A is an alternate chart of hot and cold water temperatures depicting periods of hot water demand and flow.

FIG. 17A shows an alternate method of sensing, measuring and recording demands for hot water. In particular, the divergence of the temperature of the cold water line CL 206 and hot water line HL 208 as at A signals the start of flow of hot water from the water storage tank 204 and the convergence temperature of the cold water line CL 206 and hot water line HL 208 as at B indicates a cession of the flow of hot water from the water storage tank 204. The period of time between A and B is the time the hot water is flowing from the water storage tank 204. Since the elapsed period between A and B is less than about two (2) minutes, the microprocessor 102 records a predetermined minimum quantity for hot water demand or event. Similarly, the divergence of the temperature of the cold water line CL 206 and hot water line HL 208 as at C signals the start of another flow of hot water from the water storage tank 204 and the convergence of the temperatures of the cold water line CL 206 and hot waterline HL 208 as at D indicates of cession of the flow of hot water from the water storage tank 204. The period of time between C and D is the time the hot water is flowing from the water storage tank 204. Since the elapsed period between C and D is greater than two (2) minutes, the microprocessor 102 records a predetermined maximum quantity for hot water demand or event.

In other words, when there is no flow of hot water through the water storage tank 204 the temperatures sensed at the inlet pipe 206 and outlet pipe 208 of the water storage tank 204 are substantially the same or equal to each other. Flow of hot water from the water storage tank 204 is detected or determined by comparing the temperatures of the inlet water sensed by the inlet water sensor 220 and the outlet water by an outlet water sensor 222 in the microprocessor 106 and generating a flow signal when the difference between the inlet water temperature and the outlet water temperature is a predetermined amount such as substantially equal to or greater than about 2.5° F. When the temperature difference between the inlet water and the outlet water decreased to a predetermined amount such as substantially about 1° F. or less than the flow signal ceases.

The microprocessor 102 includes means to record incrementally when the flow of water from the water storage tank 204 starts or commences and stops or ceases incrementally defined by a first table or set of equal time periods such as 15 seconds to measure or detect the demand for the first quantity of hot water a first period of time such as about two (2) minutes or greater and a second table or set of equal time period such as 5 seconds to measurer or detect the demand for the second quantity of hot water as a second period of time such as between about thirty (30) seconds and about two (2) minutes.

A demand for hot water less than a predetermined time period such as about thirty (30) seconds is not recorded as a demand for hot water.

The time at which the heating elements 214 and 216 must be energized to meet the predicted hot water demand is determined by the water heater characteristics and quantity of demand for hot water adjusted for variations of actual hot water usage.

Figure 19:
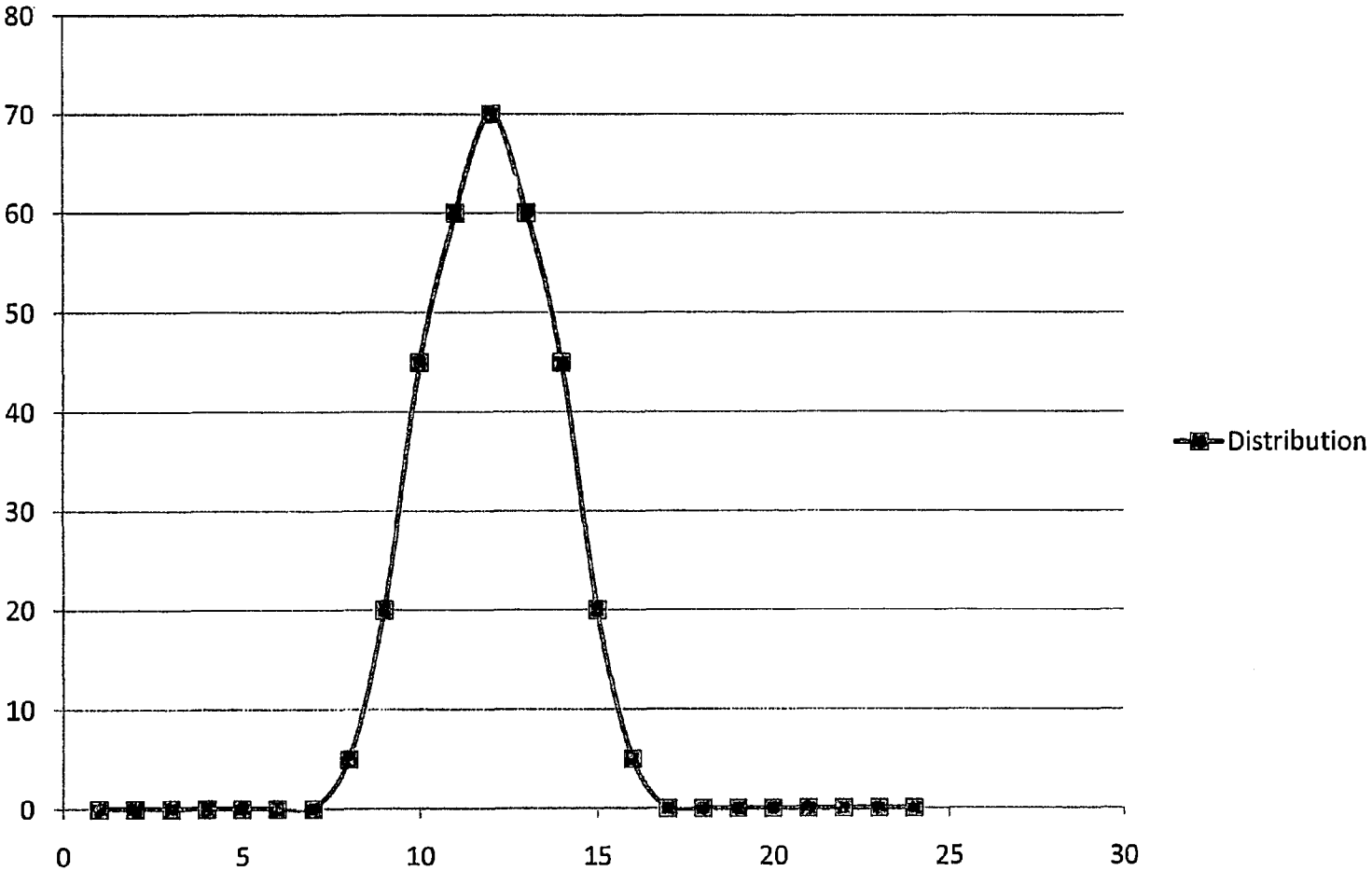
FIG. 19 is a graph depicting a predicted hot water usage distribution curve from the data set forth in the table for FIG. 18.
Figure 20:
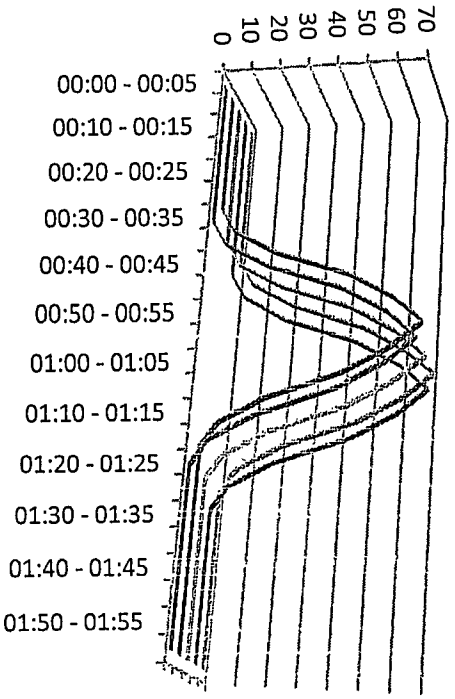
FIG. 20 is a graph depicting a plurality of predicted hot water usage distribution curves for each work day of a week.
Figure 21:
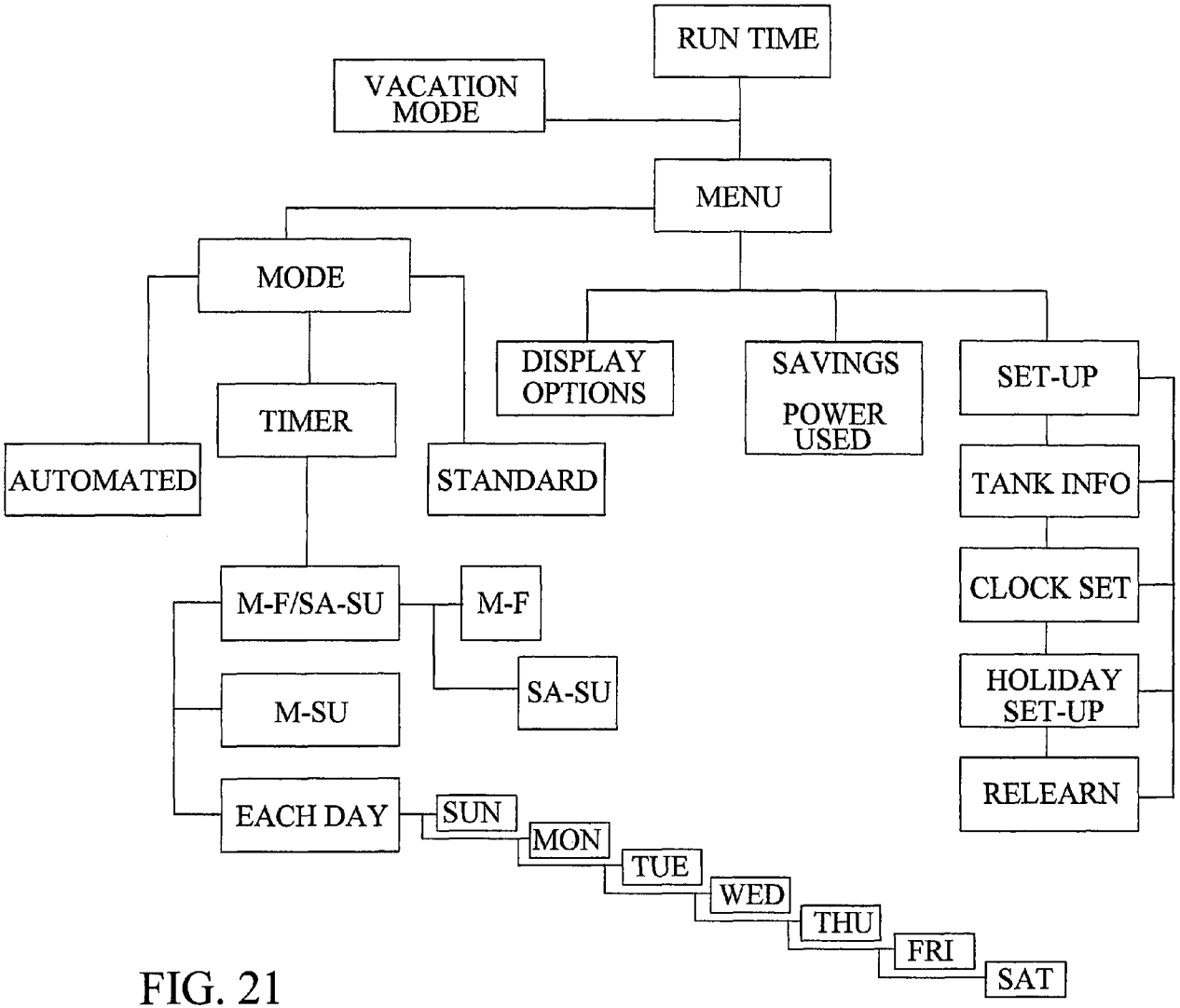
FIG. 21 depicts the operating control options accessible on the front panel of the present invention.

The daily time demands for hot water are recorded for a predetermined number of weekly cycles such as ten (10) weeks and averaged as shown in FIG. 19. The average peak time for the recorded demands are set back along the bell curve to establish a first margin set back margin from the average peak time. A second set back margin such as fifteen (15) minutes for large demand events and ten (10) minutes for small demand events.

The energy conservation system which maintains the water storage tank at a minimum temperature such as 85° F. is capable of heating the water within the water storage tank to a first predetermined temperature such as 114° F. or a first predetermined range such as from 100° to 114° F. to supply a first predetermined minimum quantity of hot water at a predetermined time of day on a given day of the week or heating the water within the water storage tank to a second predetermined temperature such as 85° F. or a second predetermined temperature range such as from 85° F. to 100° F. to supply a second predetermined minimum quantity of hot water at a predetermined time of day on any given day of the week derived from the duration or period of time that a hot water demand occurs during a learning period comprising a plurality of cycles such as ten (10) weeks. The demand for the first predetermined minimum quantity of hot water and for the second determined minimum quantity of hot water is measured or defined as substantially two (2) minutes or more of water flow from the water storage tank and between substantially thirty (30) seconds and substantially two (2) minutes of water flow from the water storage tank 204 respectively. The maximum temperature such as 114° F. will always be set below the thermostat so that the microprocessor 102 will have full control of the water temperature.

The microprocessor 102 includes logic to determine and set the minimum operating temperatures set point for the water heater 202 as a function of the inlet or cold water temperature fed into the water storage tank 204. For example, the inlet water temperature may range from an average of 37° F. in northern climates to an average of 72° F. in southern climates. Thus, to account for the variation in regions as well as variations throughout the year in a locale subject to significant seasonal temperature swings, the microprocessor 102 increases the minimum set point as the inlet water temperature decreases to meet the increased need or demand for energy to heat and maintain the water temperature with the water storage tank 204. The microprocessor 102 may include logic to compensate for variations of ambient air in the water temperature.

Power usage is measured by the current or amperage sensor 22 (FIG. 3) and recorded so that the microprocessor 102 can calculate and display actual power used and money saved for a predetermined period such as a month by the LCDs viewable through LDC display window 230 when selected on the system control buttons or switches 232 (FIG. 16).

The energy conservation system may operate in an override mode to de-energize the heating elements 214 and 216 by selecting the override mode through the use of the buttons or keys 232 to avoid any use of power or energy such as during an extended absence while on vacation (FIG. 16). Upon return from vacation, the energy conservation system may be returned to the automated mode using the previous pattern of hot water usage.

In addition, the energy conservation system may operate in a standard mode selected by the buttons or keys 232 wherein the water with the water storage tank 204 is maintained at a fixed temperature set point without response to usage or demand (FIG. 16).

Finally, a user can program the energy conservation system to operate under a one of a plurality of selected time and day regime by buttons or keys 232 (FIGS. 16 and 21) similar to the programmable hot water controller disclosed in Pub. N. US 2006/0196956.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An energy conservation system to selectively control the operation of the heating element of a water heater including a water storage tank having a tank inlet and a tank outlet operable in an automated mode to control the temperature of water within the water storage tank comprising a plurality of temperature sensors including a cold temperature sensor and a hot temperature sensor to sense the inlet water temperature and the outlet water temperature at the tank inlet and the tank outlet respectively to generate a cold temperature signal and a hot temperature signal corresponding to the water temperature at the tank inlet and the tank outlet respectively and a tank temperature sensor to sense the tank temperature of the water within the water storage tank and generate a tank temperature signal corresponding to the water temperature within the water storage tank and a microprocessor coupled to the plurality of temperature sensors to receive the corresponding temperature signals including means to determine when there is a demand for hot water from the water storage tank and means to determine a pattern for the demand of hot water over a predetermined cycle defined by the time of day and duration of water usage events to provide a supply of hot water in response to a demand for a first quantity of hot water by heating the water for a first predetermined time prior to the demand for the first quantity of hot water or in response to a demand for a second quantity of hot water by heating the water for a second predetermined time prior to the demand for the second quantity of hot water.

2. An energy conservation system to selectively control the operation of the heating element of a water heater including a water storage tank having a tank inlet and a tank outlet operable in an automated mode to control the temperature of water within the water storage tank comprising a plurality of temperature sensors including a cold temperature sensor and a hot temperature sensor to sense the inlet water temperature and the outlet water temperature at the tank inlet and the tank outlet respectively to generate a cold temperature signal and a hot temperature signal corresponding to the water temperature at the tank inlet and the tank outlet respectively and a tank temperature sensor to sense the tank temperature of the water within the water storage tank and generate a tank temperature signal corresponding to the water temperature within the water storage tank and a microprocessor coupled to the plurality of temperature sensors to receive the corresponding temperature signals including means to determine when there is a demand for hot water from the water storage tank and means to determine a pattern for the demand of hot water over a predetermined cycle defined by the time of day and duration of water usage events to heat the water within the water storage tank to a first predetermined temperature at substantially the time of the demand for the first quantity of hot water or to heat the water within the water storage tank to a second predetermined temperature at substantially the time of demand for the second quantity of hot water.

3. An energy conservation system to selectively control the operation of the heating element of a water heater including a water storage tank having a tank inlet and a tank outlet operable in an automated mode to control the temperature of water within the water storage tank comprising a plurality of temperature sensors including a cold temperature sensor and a hot temperature sensor to sense the inlet water temperature and the outlet water temperature at the tank inlet and the tank outlet respectively to generate a cold temperature signal and a hot temperature signal corresponding to the water temperature at the tank inlet and the tank outlet respectively and a tank temperature sensor to sense the tank temperature of the water within the water storage tank and generate a tank temperature signal corresponding to the water temperature within the water storage tank and a microprocessor coupled to the plurality of temperature sensors to receive the corresponding temperature signals including means to determine when there is a demand for hot water from the water storage tank and means to determine a pattern for the demand of hot water over a predetermined cycle defined by the time of day and duration of water usage events to provide a supply of hot water in response to a demand for a first quantity of hot water by heating the water for a first predetermined time prior to the demand for the first quantity of hot water or in response to a demand for a second quantity of hot water by heating the water for a second predetermined time prior to the demand for the second quantity of hot water.

4. An energy conservation system to selectively control the operation of the heating elements of a water heater including a water storage tank operable in an automated mode to control the temperature of water within the water storage tank comprising a flow detector to detect the flow of water from the water storage tank measured in time and duration and a tank temperature sensor to sense the water temperature within the storage tank and generate corresponding temperature signals and a microprocessor coupled to said flow detector and said tank temperature sensor to receive the corresponding signals including means to determine when there is a demand for hot water and means to determine a pattern of hot water usage over a water usage cycle to maintain the water in the water storage tank at a minimum temperature to supply a minimum quantity of hot water and increase the temperature of the water to a maximum temperature to supply a maximum quantity of hot water corresponding to the pattern of hot water usage over the water usage cycle, said flow detector comprising a temperature sensor to sense the inlet water temperature to detect a change in temperature and generate a signal fed to said microprocessor when the temperature decreases a predetermined amount to indicate the start of flow of hot water from the water storage tank until the temperature of the cold water line increases a predetermined amount to indicate cession of the flow of hot water from the water storage tank such that when the flow of hot water from the water storage tank is greater than a predetermined duration said microprocessor records a demand for a predetermined maximum quantity for hot water and when the flow of hot water from the water storage tank is less than a predetermined duration the microprocessor records a demand for a predetermined minimum quantity for hot water.

5. The energy conservation system of claim 4 wherein the duration of flow of hot water from the water storage tank is less than a second minimum period no demand for hot water is recorded.

6. An energy conservation system to selectively control the operation of the heating elements of a water heater including a water storage tank operable in an automated mode to control the temperature of water within the water storage tank comprising a flow detector to detect the flow of water from the water storage tank measured in time and duration and a tank temperature sensor to sense the water temperature within the storage tank and generate corresponding temperature signals and a microprocessor coupled to said flow detector and said tank temperature sensor to receive the corresponding signals including means to determine when there is a demand for hot water and means to determine a pattern of hot water usage over a water usage cycle to maintain the water in the water storage tank at a minimum temperature to supply a minimum quantity of hot water and increase the temperature of the water to a maximum temperature to supply a maximum quantity of hot water corresponding to the pattern of hot water usage over the water usage cycle, said flow detector comprising a temperature sensor to sense the outlet water temperature to detect a change in temperature and generate a signal fed to said microprocessor when the temperature decreases a predetermined amount to indicate the start of flow of hot water from the water storage tank until the temperature of the cold water line increases a predetermined amount to indicate cession of the flow of hot water from the water storage tank such that when the flow of hot water from the water storage tank is greater than a predetermined duration said microprocessor records a demand for a predetermined maximum quantity for hot water and when the flow of hot water from the water storage tank is less than a predetermined duration the microprocessor records a demand for a predetermined minimum quantity for hot water.

7. The energy conservation system of claim 6 wherein the duration of flow of hot water from the water storage tank is less than a second minimum period no demand for hot water is recorded.

8. An energy conservation system to selectively control the operation of the heating elements of a water heater including a water storage tank operable in an automated mode to control the temperature of water within the water storage tank comprising a flow detector to detect the flow of water from the water storage tank measured in time and duration and a tank temperature sensor to sense the water temperature within the storage tank and generate corresponding temperature signals and a microprocessor coupled to said flow detector and said tank temperature sensor to receive the corresponding signals including means to determine when there is a demand for hot water and means to determine a pattern of hot water usage over a water usage cycle to maintain the water in the water storage tank at a minimum temperature to supply a minimum quantity of hot water and increase the temperature of the water to a maximum temperature to supply a maximum quantity of hot water corresponding to the pattern of hot water usage over the water usage cycle, said flow detector comprising a temperature sensor to sense the inlet water temperature and a temperature sensor to sense the outlet water temperature to detect a divergence of the temperature of the inlet water temperature and the outlet water temperature a predetermined amount and generate a signal fed to said microprocessor to indicate the start of flow of hot water from the water storage tank and the convergence temperature of the inlet water temperature and outlet water temperature a predetermined amount indicates a cession of the flow of hot water from the water storage tank such that when the time the hot water is flowing from the water storage tank is less than a predetermined duration said microprocessor records a minimum demand for hot water and when the time the hot water is flowing from the water storage tank is greater than a predetermined duration, said microprocessor records a predetermined maximum quantity demand for hot water.

9. An energy conservation system to selectively control the operation of the heating elements of a water heater including a water storage tank operable in an automated mode to control the temperature of water within the water storage tank comprising a flow detector to detect the flow of water from the water storage tank measured in time and duration and a tank temperature sensor to sense the water temperature within the storage tank and generate corresponding temperature signals and a microprocessor coupled to said flow detector and said tank temperature sensor to receive the corresponding signals including means to determine when there is a demand for hot water and means to determine a pattern of hot water usage over a water usage cycle to maintain the water in the water storage tank at a minimum temperature to supply a minimum quantity of hot water and increase the temperature of the water to a maximum temperature to supply a maximum quantity of hot water corresponding to the pattern of hot water usage over the water usage cycle, said microprocessor including logic to record the day and duration of demands for hot water and generate control signals to control the operation of the heating elements to provide the predetermined maximum of hot water and the minimum of hot water in response to demands for hot water.

10. The energy conservation system of claim 9 wherein the heating elements are energized a first set back time from the recorded peak time for a hot water demand.

11. The energy conservation system of claim 10 wherein the heating elements are energized an additional set back time for large hot water demand events and a lesser additional set back time for small hot water demand events.

12. An energy conservation system to selectively control the operation of the heating elements of a water heater including a water storage tank operable in an automated mode to control the temperature of water within the water storage tank comprising a flow detector to detect the flow of water from the water storage tank measured in time and duration and a tank temperature sensor to sense the water temperature within the storage tank and generate corresponding temperature signals and a microprocessor coupled to said flow detector and said tank temperature sensor to receive the corresponding signals including means to determine when there is a demand for hot water and means to determine a pattern of hot water usage over a water usage cycle to maintain the water in the water storage tank at a minimum temperature to supply a minimum quantity of hot water and increase the temperature of the water to a maximum temperature to supply a maximum quantity of hot water corresponding to the pattern of hot water usage over the water usage cycle, wherein the water storage tank maintains the water at a minimum predetermined temperature and heats the water within the water storage tank to a maximum predetermined temperature to supply a maximum quantity of hot water at a predetermined time of day and heats the water within the water storage tank to predetermined temperature range to supply a minimum quantity of hot water at a predetermined time of day by averaging the duration of time that a hot water demand occurs derived from sensing and recording a plurality of cold water usage cycles.

13. The energy conservation system of claim 12 wherein said maximum temperature is set below the set temperature of the thermostat such that said microprocessor controls the water temperature.

14. An energy conservation system to selectively control the operation of the heating elements of a water heater including a water storage tank operable in an automated mode to control the temperature of water within the water storage tank comprising a flow detector to detect the flow of water from the water storage tank measured in time and duration and a tank temperature sensor to sense the water temperature within the storage tank and generate corresponding temperature signals and a microprocessor coupled to said flow detector and said tank temperature sensor to receive the corresponding signals including means to determine when there is a demand for hot water and means to determine a pattern of hot water usage over a water usage cycle to maintain the water in the water storage tank at a minimum temperature to supply a minimum quantity of hot water and increase the temperature of the water to a maximum temperature to supply a maximum quantity of hot water corresponding to the pattern of hot water usage over the water usage cycle, said microprocessor including logic to determine and set the minimum operating temperature set point for the water heater as a function of the inlet or cold water temperature fed into the water storage tank to account for the variation in regions and variations throughout the year in a locale subject to significant seasonal temperature swings such that said microprocessor increases the minimum set point as the inlet water temperature decreases to meet the increased need or demand for energy to heat and maintain the water temperature with the water storage tank.

* * * * *